US008628245B2

(12) United States Patent
Katayama

(10) Patent No.: US 8,628,245 B2
(45) Date of Patent: Jan. 14, 2014

(54) CONNECTION STRUCTURE OF LINEAR MOTOR TYPE TRANSPORT DEVICE

(75) Inventor: Manabu Katayama, Shizuoka (JP)

(73) Assignee: Yamaha Hatsudoki Kabushiki Kaisha, Shizuoka-Ken (JP)

( * ) Notice: Subject to any disclaimer, the term of this patent is extended or adjusted under 35 U.S.C. 154(b) by 296 days.

(21) Appl. No.: 13/236,370

(22) Filed: Sep. 19, 2011

(65) Prior Publication Data

US 2012/0085833 A1 Apr. 12, 2012

(30) Foreign Application Priority Data

Oct. 7, 2010 (JP) ..... 2010-227214
Dec. 1, 2010 (JP) ..... 2010-268254

(51) Int. Cl.
*F16C 29/00* (2006.01)

(52) U.S. Cl.
USPC ..... 384/55; 384/59

(58) Field of Classification Search
USPC ..... 384/55, 59, 43–45; 238/151, 175
See application file for complete search history.

(56) References Cited

U.S. PATENT DOCUMENTS

| | | | | |
|---|---|---|---|---|
| 5,431,497 | A * | 7/1995 | Nonaka | 384/45 |
| 5,501,528 | A * | 3/1996 | Agari et al. | 384/45 |
| 5,735,214 | A * | 4/1998 | Tsuboi | 105/29.1 |
| 6,227,708 | B1 * | 5/2001 | Rixen et al. | 384/45 |
| 2003/0198410 | A1 * | 10/2003 | Baumann | 384/55 |
| 2006/0029309 | A1 * | 2/2006 | Ito | 384/59 |
| 2007/0065056 | A1 * | 3/2007 | Greubel et al. | 384/59 |

FOREIGN PATENT DOCUMENTS

JP 63-075202 4/1988

* cited by examiner

*Primary Examiner* — Thomas R Hannon
(74) *Attorney, Agent, or Firm* — Studebaker & Brackett PC

(57) ABSTRACT

A connection structure of first and second linear motor type transport devices each having a base part, and a rail part set on the top surface of the base part is provided, including: a notch concave part formed in the top surfaces of the base parts with both devices connected; a reference positioning part serving as a reference position of lower edges on one side in the width direction of the rail parts; a bottom surface support part disposed in the notch concave part, and set between the bottom surface of the notch concave part and the bottom surfaces of the rail parts; and a pressing member interposed between the wall part of the notch concave part and lower edges on the other side of the rail parts, and urging the lower edges on the other side of the rail parts toward the reference positioning part, thereby linearly fixing the first and second linear motor type transport devices to be connected.

12 Claims, 20 Drawing Sheets

REAR
RIGHT
FRONT
LEFT 31
31a
31b
17c
37b
37
37a
11f
38b
38
38a 31
31a
11a
11b 31
31a
37b
37
37a
11c
11a
11b 31
38a
38
38b
31a
11b
11a
11c

CONNECTION STRUCTURE OF LINEAR MOTOR TYPE TRANSPORT DEVICE

BACKGROUND OF THE INVENTION

1. Field of the Invention

The present invention relates to a connection structure of a linear motor type transport device, which connects a plurality of linear motor type transport devices, with end faces thereof abutting against each other.

2. Description of the Background Art

In the related art, in a long transport apparatus using a linear motor, a plurality of short linear motor type transport devices each including a base part and a rail part are connected to one another with the end faces abutting against each other. In some of such transport apparatuses, members for linearly positioning the linear motor type transport devices are each mounted to the connection part of each linear motor type transport device. Through the members, a plurality of the linear motor type transport devices are connected (e.g., see Japanese Patent Application Laid-open No. S63-75202).

In the linear motor type transport device (traveling rail for transport device), a traveling rail is disposed along a rail fixing piece provided on the support surface of the rail pedestal. The traveling rail is fixed to the rail fixing piece by bolts. The end faces of the traveling rails to be connected are each formed in an obliquely inclined surface. When both the end faces to be connected are brought in contact with each other, the two traveling rails become linear. Further, in the side surfaces of the rail pedestals, there are disposed dovetail grooves respectively extending in the longitudinal direction. A connection key is inserted into the dovetail grooves in such a manner as to be laid across the dovetail grooves of the two rail pedestals. Thus, the connection key is fixed to the rail pedestals by bolts. As a result, the rail pedestals are connected.

In the related-art linear motor type transport devices, precise linear connections between the base parts and between the traveling rails require all of the dimensional precision between the dovetail grooves and the connection key, the contact precision between the rail fixing pieces and the traveling rails, and the contact precision between the end faces of the traveling rails. However, it is difficult to combine all of these with high precision.

SUMMARY OF THE INVENTION

An object of the present invention is to provide a connection structure of a linear motor type transport device capable of linearly connecting a plurality of linear motor type transport devices with an easy method.

A connection structure of a linear motor type transport device in accordance with one aspect of the present invention, which achieves the object, includes: a first linear motor type transport device including a first base part, and a first rail part disposed on a top surface of the first base part, and having a first end face for connection; a second linear motor type transport device including a second base part, and a second rail part disposed on a top surface of the second base part, and having a second end face to be butt-connected to the first end face; a notch concave part including a first concave part and a second concave part included in top surfaces of an end on the first end face side of the first base part and an end on the second end face side of the second base part, respectively, with the first concave part and the second concave part being connected to each other, and the notch concave part being configured to have a larger width than each width of the first and second rail parts; a reference positioning part serving as a reference position of each of lower edges on one side, in the width direction, of the first and second rail parts; a bottom surface support part disposed in the notch concave part, and set between a bottom surface of the notch concave part and bottom surfaces of the first and second rail parts; and a pressing member interposed between a wall part of the notch concave part and lower edges on the other side of the first and second rail parts, and urging the lower edges on the other side of the first and second rail parts toward the reference positioning part, and thereby linearly fixing the first and second linear motor type transport devices to be connected.

BRIEF DESCRIPTION OF THE DRAWINGS

FIGS. 6A to 6D each show the base part of the linear motor type transport device in accordance with the first embodiment, wherein FIG. 6A is a plane view; FIG. 6B, a front view; FIG. 6C, a right side view; and FIG. 6D, a left side view;

FIGS. 7A and 7B each show a positioning member, wherein FIG. 7A is a front view, and FIG. 7B is a side view;

FIGS. 8A and 8B each show a positioning support member, wherein FIG. 8A is a front view, and FIG. 8B is a side view;

FIGS. 9A and 9B each show a wedge member, wherein FIG. 9A is a front view, and FIG. 9B is a side view;

FIGS. 20A to 20D each show the base part of the linear motor type transport device in accordance with the second embodiment, wherein FIG. 20A is a plane view; FIG. 20B, a front view; FIG. 20C, a right side view; and FIG. 20D, a left side view;

FIGS. 24A and 24B each show a positioning member, wherein FIG. 24A is a plane view, and FIG. 24B is a side view; and FIGS. 25A and 25B each show a positioning support member, wherein FIG. 25A is a plane view, and FIG. 25B is a side view.

DESCRIPTION OF THE PREFERRED EMBODIMENTS

First Embodiment

Figure 1:
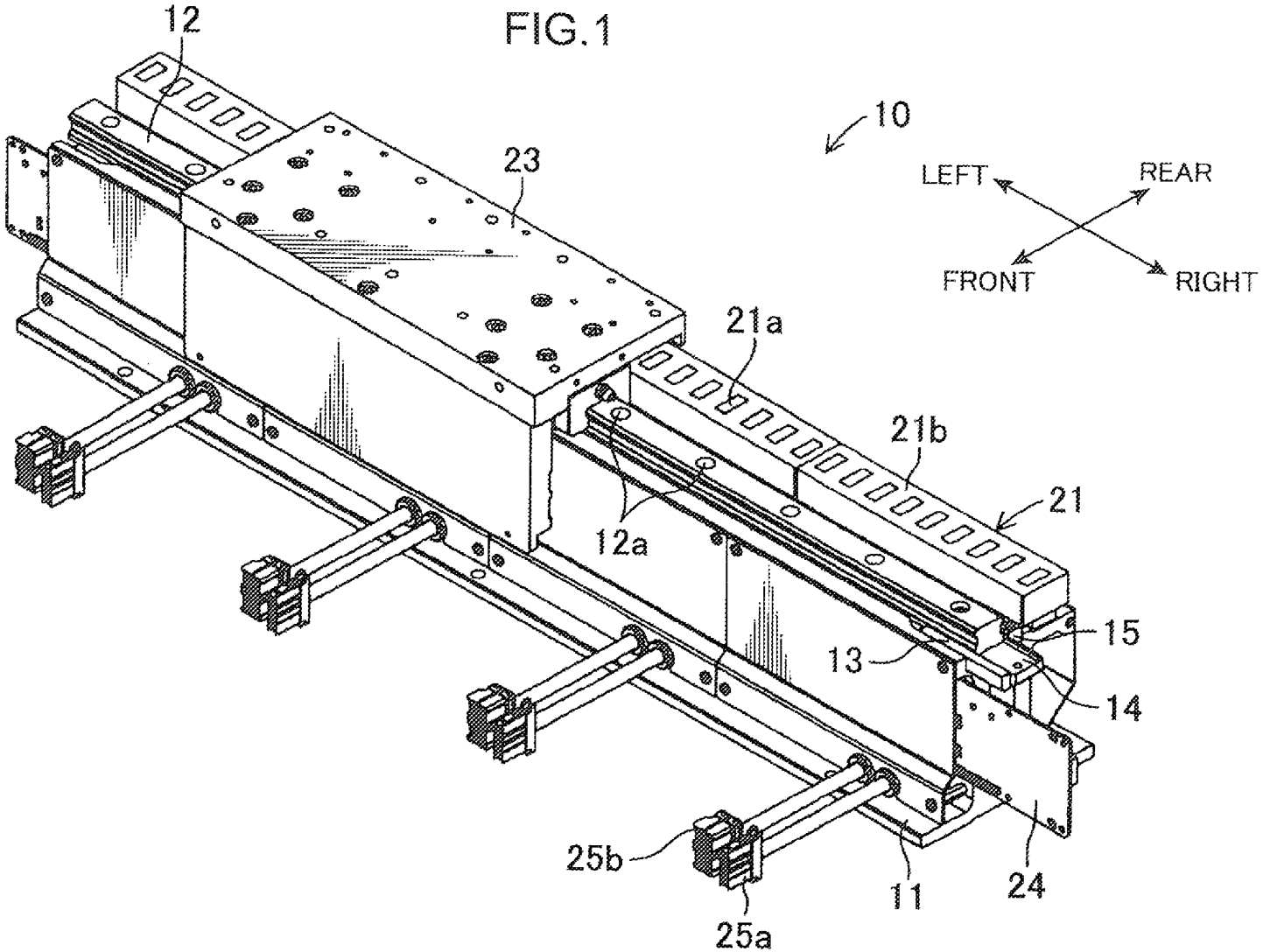
FIG. 1 is a perspective view showing a linear motor type transport device included in a connection structure of linear motor type transport devices in accordance with a first embodiment.
Figure 2:
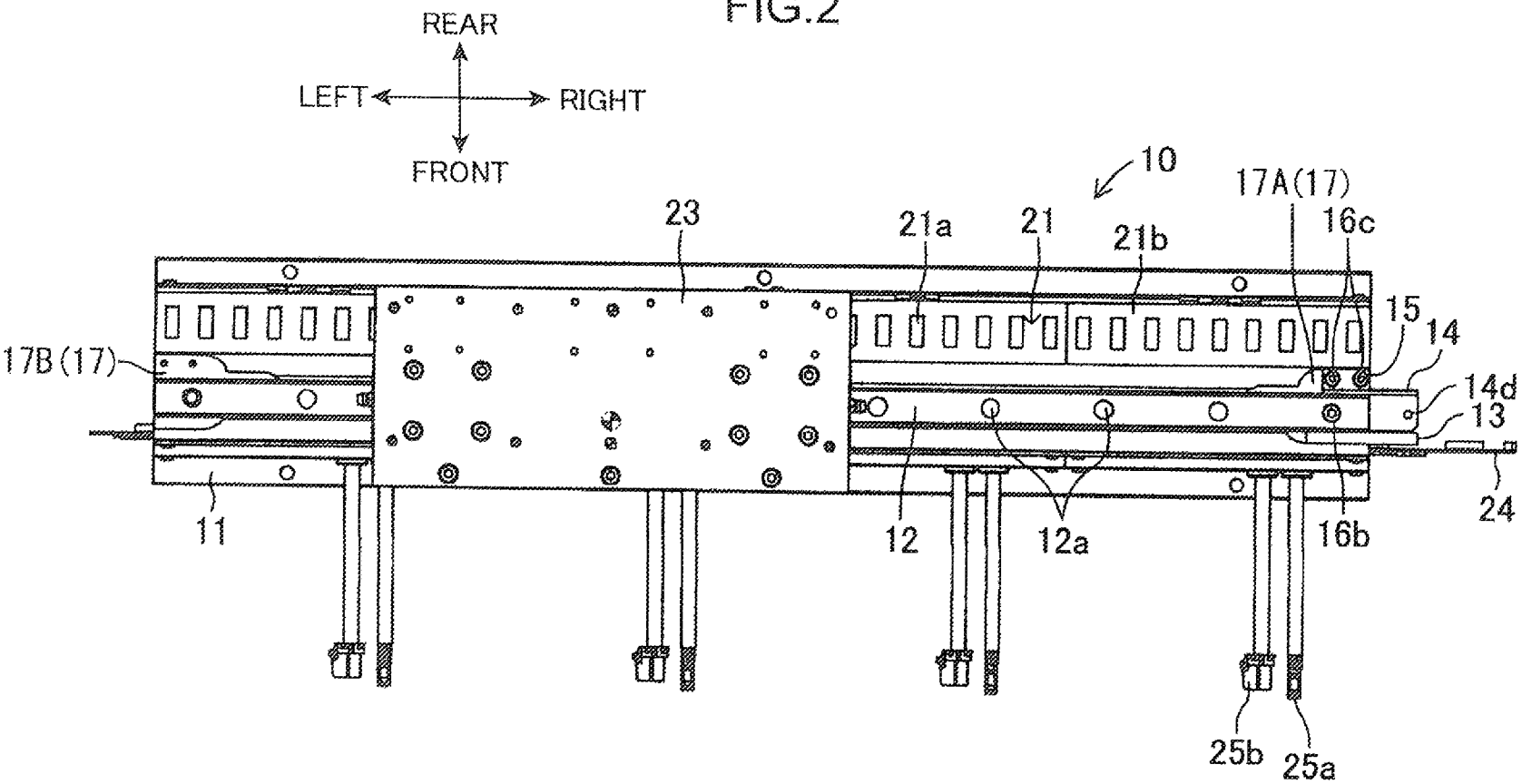
FIG. 2 is a plane view showing the linear motor type transport device in accordance with the first embodiment.
Figure 3:
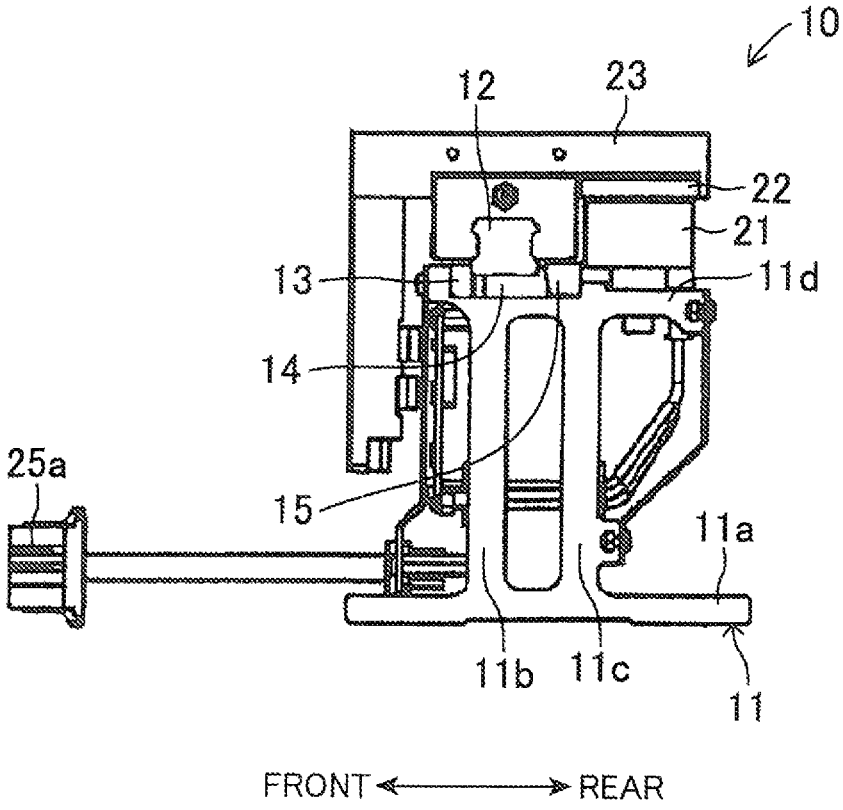
FIG. 3 is a side view showing the linear motor type transport device in accordance with the first embodiment.
Figure 12:
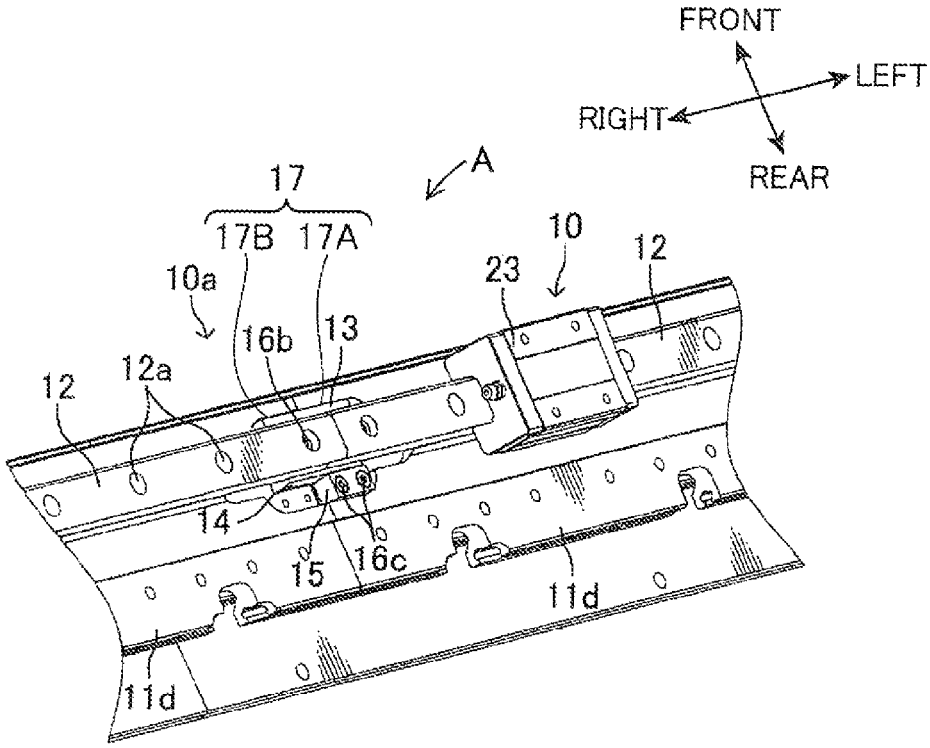
FIG. 12 is a perspective view showing a connection portion of the linear motor type transport devices in accordance with the first embodiment.

Below, a connection structure of linear motor type transport devices in accordance with a first embodiment will be described by reference to the accompanying drawings. FIGS. 1 to 3 each show one linear motor type transport device 10 (first linear motor type transport device) forming a connection structure A (see FIG. 12) of linear motor type transport devices in accordance with the present embodiment. The linear motor type transport device 10 is included in transport devices of a transport robot. A plurality of the transport devices 10 are linearly connected to form a long conveyor. In the following explanation, a description will be given with the front-side diagonally left lower side as the front side, the rear-side diagonally right upper side as the rear side, the diagonally left upper side as the left-hand side, and the diagonally right lower side as the right-hand side of FIG. 1. Further, in the present embodiment, the front side is referred to as one side in accordance with the present invention, and the rear side is referred to as the other side in accordance with the present invention.

Figure 4:
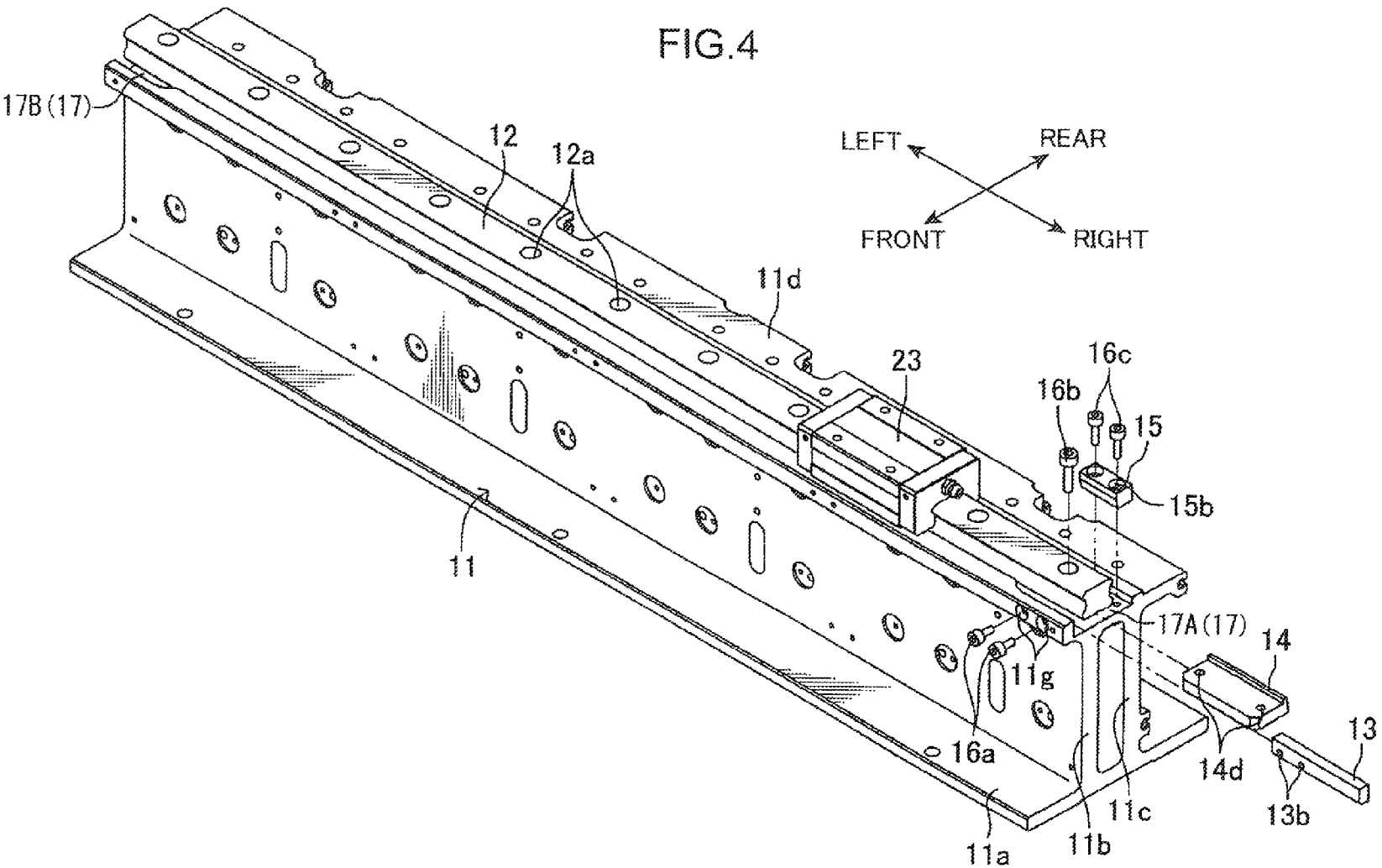
FIG. 4 is a perspective view showing an exploded state of an essential part of the linear motor type transport device in accordance with the first embodiment.
Figure 5:
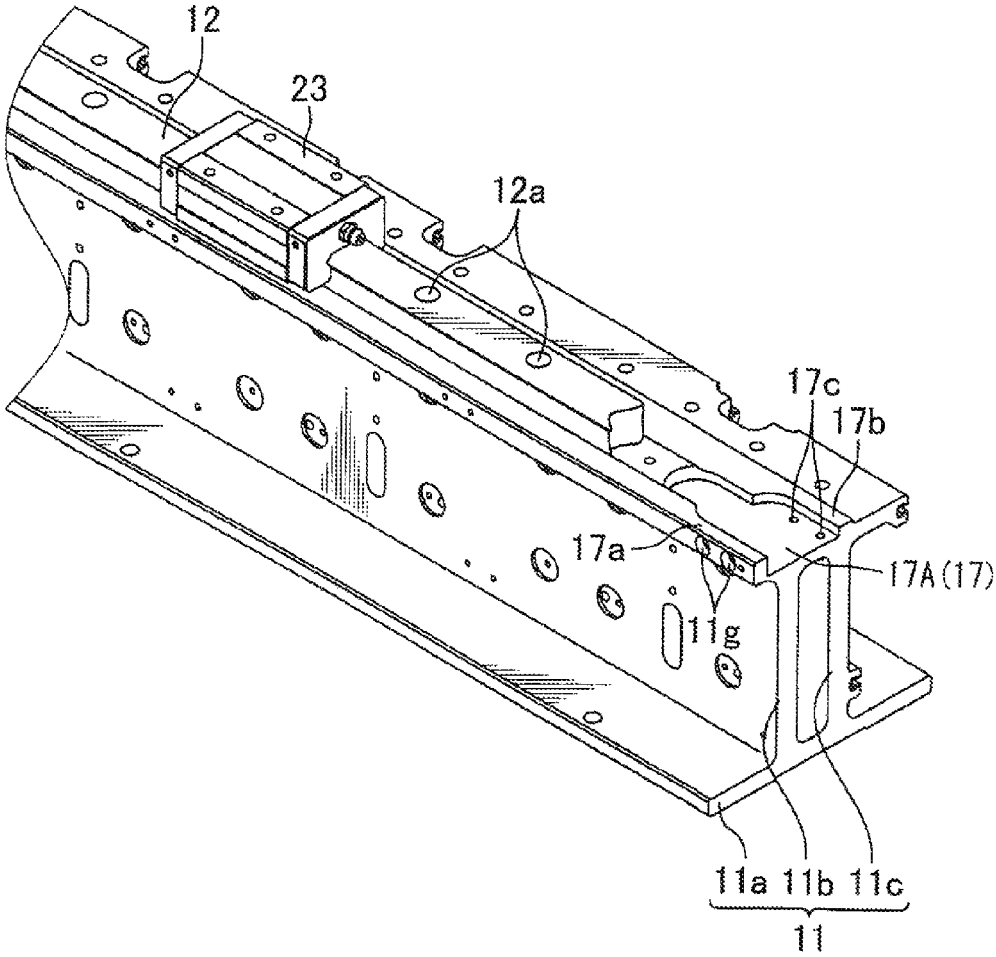
FIG. 5 is a perspective view showing a notch concave part formed in a base part of the linear motor type transport device in accordance with the first embodiment.
Figure 6A:
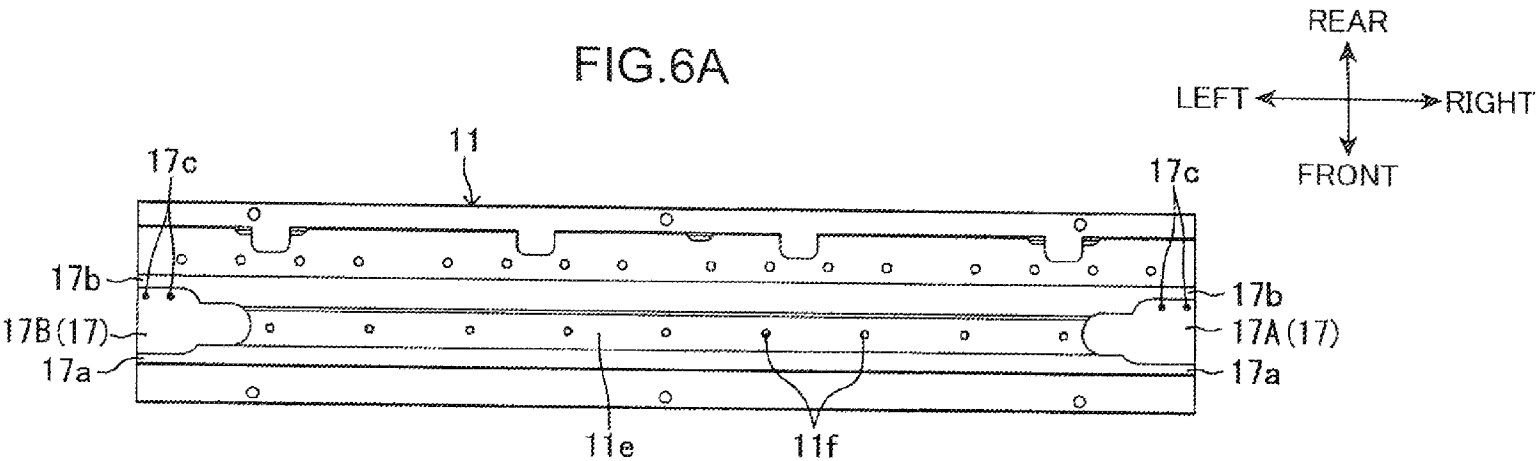
Figure 6C:
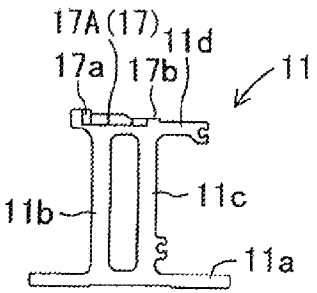
Figure 6B:
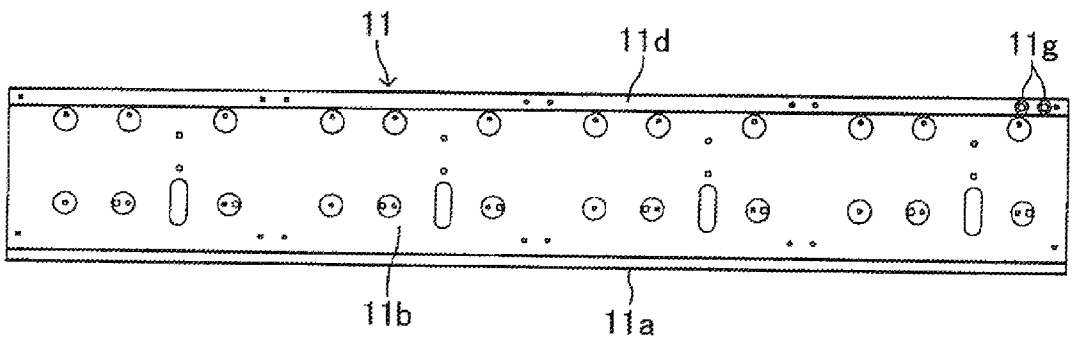
Figure 6D:
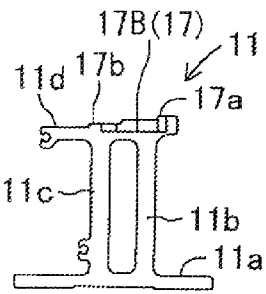

The main body portion of the linear motor type transport device 10 includes a base part 11 (first base part) and a rail part 12 (first rail part) set on the top surface of the base part 11. Further, the end face (first end face) of the one linear motor type transport device 10 and the end face (second end face) of the other linear motor type transport device 10*a* (second linear motor type transport device; see FIG. 12) are, as shown in FIG. 4, connected to each other by a positioning member 13 (reference positioning part/a part of a pressing member), a positioning support member 14 (bottom surface support part), a wedge member 15 (a part of the pressing member), and a plurality of screws 16*a*, 16*b*, and 16*c*.

The base part 11 includes, as shown in FIGS. 4 to 6B, a bottom part 11*a* in the form of a slim plate extending from left to right, a pair of perpendicular parts 11*b* and 11*c* formed with an interval kept from front to rear on the center side in the front-rear width direction of the bottom part 11*a*, and a horizontal part 11*d* laid across the upper ends of the perpendicular parts 11*b* and 11*c*, and with a smaller front-rear width than that of the bottom part 11*a*.

On the front side of the top surface of the horizontal part 11*d*, there is formed a rail setting part 11*e* extending from left to right. On the right end (first end face) side of the rail setting part 11*e*, a shallowly recessed first concave part 17A is formed; and on the left end (second end face) side, a shallowly recessed second concave part 17B is formed. When the first concave part 17A undergoes the linear connection at the right end thereof, it is connected with the second concave part 17B included in another linear motor type transport device 10*a*, resulting in the formation of one notch concave part 17. Similarly, the second concave part 17B is connected with a first concave part 17A included in a still other linear motor type transport device, resulting in the formation of one notch concave part 17.

The first concave part 17A is a width-varying concave part in which the portion situated on the end side of the horizontal part 11*d* is larger in width than the portion on the recess side in the left-right direction. The front-rear width of the portion on the end side of the first concave part 17A is larger than the width of the rail setting part 11*e*. The front part and the rear part of the portion respectively protrude toward the outsides of the rail setting part 11*e*. Further, the width of the portion on the recess side of the first concave part 17A is slightly larger than the width of the rail setting part 11*e*. Only the rear part thereof protrudes toward the outside of the rail setting part 11*e*. The length in the left-right direction of the notch concave part 17 formed by connection between the first concave part 17A and the second concave part 17B is slightly longer than the length of a positioning support member 14 described later. This allows the notch concave part 17 to accommodate the positioning support member 14 therein.

Further, on the front and rear opposite sides of the end side portion of the first concave part 17A (notch concave part 17), there are formed wall parts 17*a* and 17*b* (a wall part on one side and a wall part on the other side). The opposing inner wall surfaces of the wall parts 17*a* and 17*b* are each formed in a flat surface extending straight in parallel with the rail setting part 11*e*. In the rail setting part 11*e*, a plurality of tapped holes 11*f* are formed at a given interval. On the rear side of the bottom part of the first concave part 17A, a pair of tapped holes 17*c* are formed with an interval kept from left to right therebetween. Further, in the front right-hand side portion of the horizontal part 11*d*, a pair of through holes 11*g* penetrating from the front surface of the horizontal part 11*d* through the wall part 17*a* are formed with a space kept therebetween.

The rail part 12 includes a slim rod body having the same width as the front-rear width of the rail setting part 11*e*. The cross-sectional shape is generally a tetragon with rounded corner portions and with the opposite side parts each recessed on the center side in the vertical direction. In the rail part 12, there are formed a plurality of vertically penetrating through holes 12*a* disposed at the same interval as that of the tapped holes 11*f*. The through holes 12*a* are formed larger in number by two than the tapped holes 11*f*. Into the through holes 12*a* except for the through holes 12*a* formed on the opposite sides of the rail part 12, screws (not shown) are inserted, so that the screws are screwed into their corresponding tapped holes 11*f*, respectively. As a result, the rail part 12 is fixed to the rail setting part 11*e*. The bottom surfaces of the opposite end portions of the rail part 12 are separated from the bottom surface of the notch concave part 17.

Figure 7A:
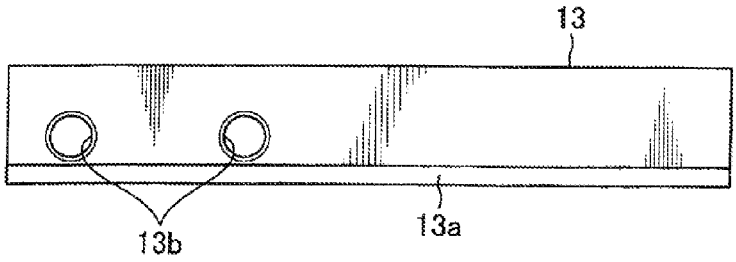
Figure 7B:
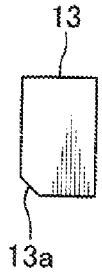

The positioning member 13 is, as shown in FIGS. 7A and 7B, formed in the shape of a laterally extending slim tetragonal rod body whose corner portion of the front surface and the bottom surface includes an inclined surface 13*a*. The vertical length of the positioning member 13 is longer than the width in the front-rear direction. In the left-hand side portion of the positioning member 13, a pair of tapped holes 13*b* penetrating from front to rear are formed with the same interval as that of a pair of the through holes 11*g* kept therebetween. The positioning member 13 is set between the wall part 17*a* and the rail part 12 in the notch concave part 17 with a pair of the tapped holes 13*b* in alignment with a pair of the through holes 11*g*, respectively.

Figure 13:
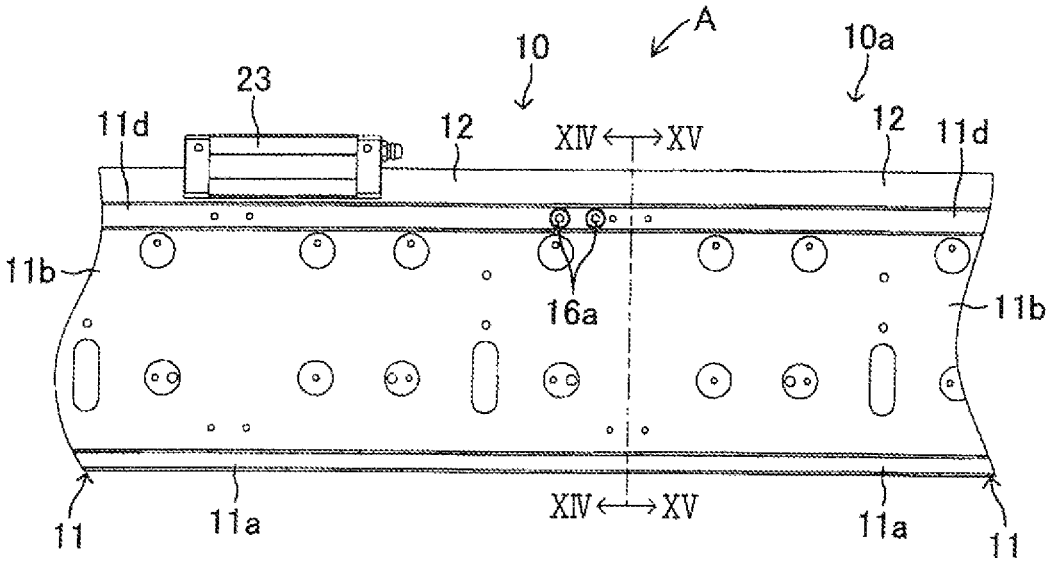
FIG. 13 is a front view showing the coupling portion of the linear motor type transport devices in accordance with the first embodiment.

The screws 16*a* are inserted from the front surface side of the horizontal part 11*d* into their corresponding through holes 11*g*, respectively, and are screwed into their corresponding tapped holes 13*b*, respectively. As a result, the positioning member 13 is fixed to the horizontal part 11*d*. At that step, the right-hand half of the positioning member 13 protrudes from the end of the base part 11. The protruding portion of the positioning member 13 is to be accommodated in the second concave part 17B of the linear motor type transport device 10*a* (second linear motor type transport device) (see FIGS. 12 and 13) to be connected with the linear motor type transport device 10 (first linear motor type transport device), i.e., the portion corresponding to the left-hand second concave part 17B of the linear motor type transport device 10. Further, the formation of the inclined surface 13*a* prevents the positioning member 13 from interfering with the corner portion between the bottom surface and the wall part 17*a* of the first concave part 17A (notch concave part 17).

Figure 8A:
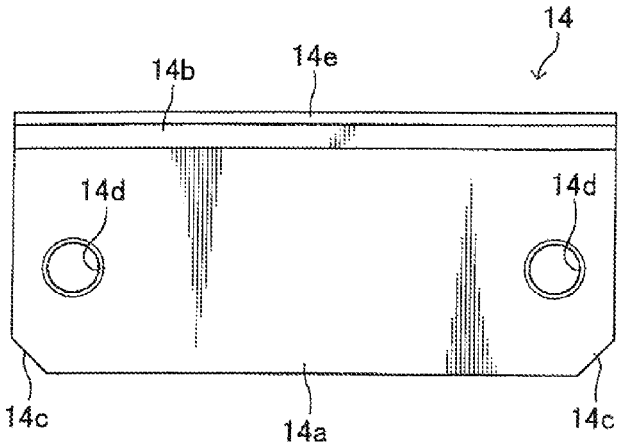
Figure 8B:
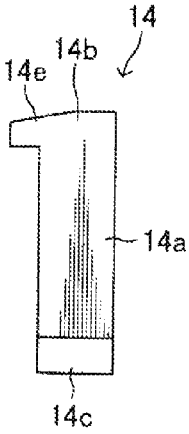

FIG. 8A shows a plane of the positioning support member 14. FIG. 8B shows the side surface of the positioning support member 14. As shown, the positioning support member 14 includes a support part 14*a* in the form of a generally tetragonal plate, and a positioning part 14*b* (pressing member) disposed at the rear part of the support part 14*a*, and having a top part protruding above the top surface of the support part 14*a*. The side surface of the positioning support member 14 has a generally L-shaped form. For the positioning support member 14, the width in the front-rear direction is set substantially the same as the width of the rail part 12, and the length in the left-right direction is, as described above, set at a length allowing accommodation in the notch concave part 17. Further, the corner portions on the opposite sides of the front part of the support part 14*a* each include an inclined surface 14*c*. In the center portions in the front-rear direction on the opposite sides of the support part 14*a*, there are formed vertically penetrating tapped holes 14*d*, respectively.

The top part of the positioning part 14*b* protrudes upward in such a manner as to be orthogonal to the top surface of the support part 14*a*. The top surface of the support part 14*a* and the front surface of the positioning part 14*b* are formed so as to be along the corner portions of the rear-side bottom parts of the rail parts 12 (the rail parts 12 of both the linear motor type transport devices 10 and 10*a* to be butted). Further, the top side portion of the rear surface of the positioning part 14*b* includes an inclined surface 14*e* with the top side inclined forward. The inclined surface 14*e* is formed at the surface of the positioning part 14*b* to be in contact with a wedge member 15 described later, and is an inclined surface inclined in a direction of heading gradually away from the side, on which the wedge member 15 is situated, as this surface heads gradually from the bottom side toward the top side.

The positioning support member 14 is disposed in the notch concave part 17 with the tapped hole 14*d* on the left-hand side in alignment with the through hole 12*a* at the right end of the rail part 12, and with the top surface of the support part 14*a* facing the bottom surface of the rail part 12. This results in a state in which the positioning part 14*b* is along the rear side lower edge portion of the rail part 12. Further, between the positioning member 13 and the positioning support member 14, a clearance is formed.

Then, the screw 16*b* is inserted from above the rail part 12 into the through hole 12*a*, and is screwed into the tapped hole 14*d* on the left-hand side of the support part 14*a*. As a result, the positioning support member 14 is fixed to the rail part 12. At this step, the right-hand half of the positioning support member 14 protrudes from the end of the base part 11. The protruding portion of the positioning support member 14 is to be accommodated in the second concave part 17B of the linear motor type transport device 10*a*, i.e., the portion corresponding to the second concave part 17A on the left-hand side of the linear motor type transport device 10. Further, the formation of the inclined surface 14*c* prevents the positioning support member 14 from interfering with the wall parts on the recess side of the first concave part 17A and the second concave part 17B, respectively.

Figure 9A:
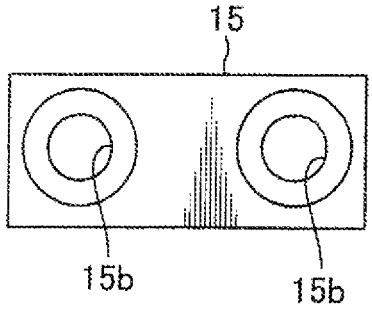
Figure 9B:
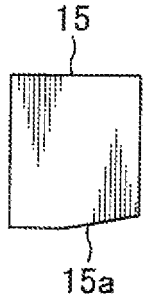

FIG. 9A shows a plane of the wedge member 15. FIG. 9B shows a side surface of the wedge member 15. As shown, the wedge member 15 has a shape of a tetragonal rod body long from left to right, and has, at the bottom side portion of the front surface thereof, an inclined surface 15*a* with the bottom side situated behind the top side. The inclined surface 15*e* is formed at a surface to be in contact with the positioning support member 14, and is an inclined surface inclined in a direction of gradually heading away from the side, on which the positioning support member 14 is situated, as this surface heads gradually from the top side toward the bottom side.

In the left and right opposite sides of the wedge member 15, there are formed a pair of uneven through holes 15*b* penetrating from top to bottom, and having a larger diameter at the top side than at the bottom side. The wedge member 15 is set between the wall part 17*b* in the notch concave part 17 and the positioning part 14*b* of the positioning support member 14 with a pair of the through holes 15*b* in alignment with a pair of the tapped holes 17*c*, respectively.

Then, two screws 16*c* are inserted from above the wedge member 15 into a pair of the through holes 15*b*, and are screwed into a pair of the tapped holes 17*c*. As a result, the wedge member 15 is fixed to the horizontal part 11*d*. The wedge member 15 is set so as to be situated in the first concave part 17A of the linear motor type transport device 10, and so as not be situated in the second concave part 17B of the linear motor type transport device 10*a*. Further, for mounting of the wedge member 15, the inclined surface 15*a* of the wedge member 15 and the inclined surface 14*e* of the positioning part 14*b* face each other. Accordingly, when the screwing between the screw 16*c* and the tapped hole 17*c* causes the wedge member 15 to move downward, the wedge member 15 urges the positioning support member 14 toward the positioning member 13. As a result, respective ends of the rail parts 12 (first and second rail parts) of the linear motor type transport devices 10 and 10*a* are sandwiched and fixed between the positioning member 13 and the positioning part 14*b*. Such fixing results in a state in which the lower edges on the rear sides of the rail parts 12 are urged toward the positioning member 13 serving as the reference positioning part.

Figure 10:
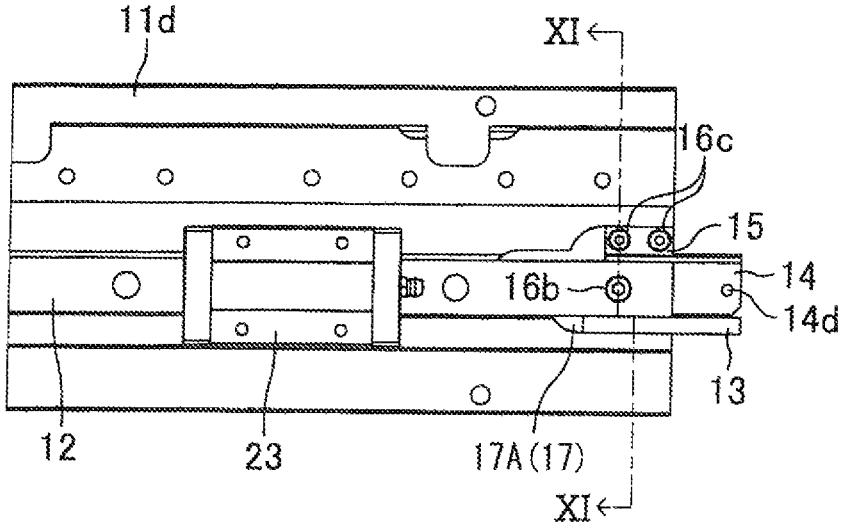
FIG. 10 is a plane view showing a state in which to the base part, there are attached the positioning member, the positioning support member, and the wedge member.
Figure 11:
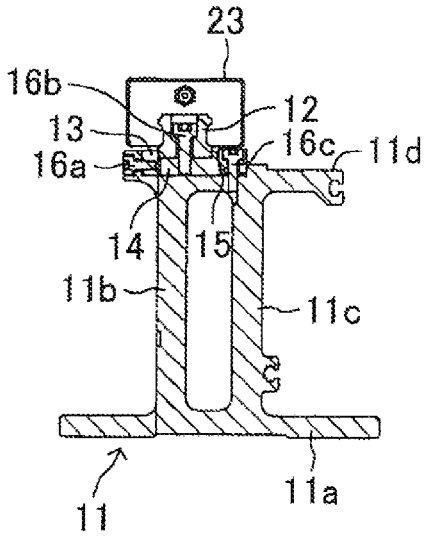
FIG. 11 is a cross-sectional view along line XI-XI of FIG. 10.
Figure 14:
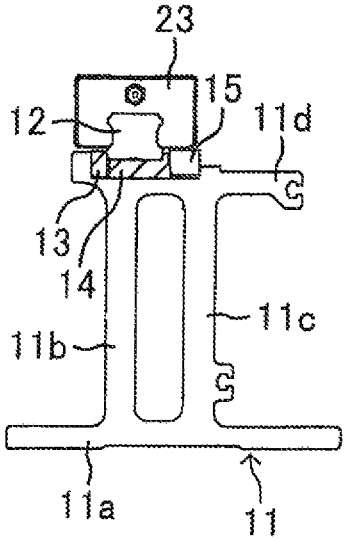
FIG. 14 is a cross-sectional view along line XIV-XIV of FIG. 13.
Figure 15:
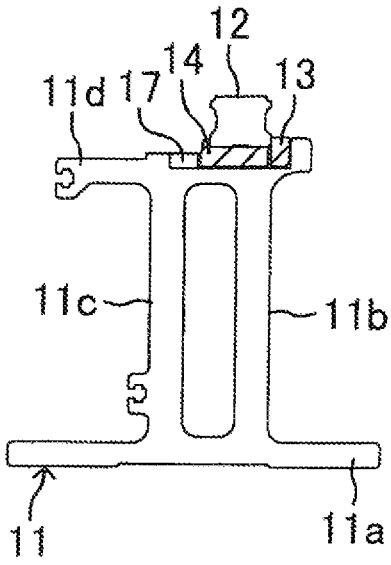
FIG. 15 is a cross-sectional view along line XV-XV of FIG. 13.

Thus, the positioning member 13, the positioning support member 14, and the wedge member 15 are, as shown in FIGS. 10 and 11, assembled to the end (first end face) of the linear motor type transport device 10. Further, to the end of the linear motor type transport device 10 to which the positioning member 13, the positioning support member 14, and the wedge member 15 are mounted, there is assembled the left-hand side end (second end face) of the linear motor type transport device 10*a* in the same shape as that of the linear motor type transport device 10. This results in a connection structure A of the linear motor type transport devices shown in FIGS. 12 and 13. Incidentally, FIG. 14 shows the cross section of the border portion between the linear motor type transport device 10 and the linear motor type transport device 10*a* of the connection structure A of the linear motor type transport devices shown in FIG. 13, as seen from the right-hand side thereof. FIG. 15 shows the cross section of the same border portion as seen from the left-hand side thereof.

In the foregoing description, to the linear motor type transport device 10, there are sequentially assembled the positioning member 13, the positioning support member 14, and the wedge member 15. However, in actuality, when the linear motor type transport device 10 and the linear motor type transport device 10*a* are assembled, the assembly work is performed with the ends of the linear motor type transport device 10 and the linear motor type transport device 10*a* abutting against each other.

In this case, a worker first causes the ends of the linear motor type transport device 10 and the linear motor type transport device 10*a* to abut against each other with the positioning support member 14 inserted into the first concave part 17A of the linear motor type transport device 10. As a result, the first concave part 17A and the second concave part 17B are connected with each other, resulting in the formation of the notch concave part 17. Then, the worker sets the positioning member 13 between the wall part 17*a* of the notch concave part 17 and the rail part 12 with the center in the left-right direction situated at the border between the linear motor type transport device 10 and the linear motor type transport device 10*a*. Thus, the positioning member 13 is firmly fixed to the horizontal part 11*d* by two screws 16*a*. The positioning member 13 becomes the reference position of the end of each rail part 12.

Then, the positioning support member 14 is moved rightward. Thus, the center in the left-right direction is situated at the border between the linear motor type transport device 10 and the linear motor type transport device 10*a*. Then, the positioning support member 14 is lightly fixed to both the rail parts 12 by two screws 16*b*. In that state, the wedge member 15 is set between the wall part 17*b* of the linear motor type transport device 10 and the positioning support member 14, and is fixed to the bottom surface of the notch concave part 17 by the screws 16*c*. Then, the two screws 16*b* mounted to both the rail parts 12 and the positioning support member 14 are firmly fastened. This results in the completion of the work of connecting the linear motor type transport device 10 and the linear motor type transport device 10*a*. Further, to the other end of the linear motor type transport device 10*a*, another linear motor type transport device is also similarly connected. Still further, to the end of the linear motor type transport device, a still other linear motor type transport device is sequentially connected.

Further, the linear motor type transport device 10 is provided with, other than the foregoing respective members, a stator 21, a slide table 23 movably attached to the rail part 12, a substrate 24, connectors 25*a* and 25*b*, and the like, shown in FIGS. 1 to 3. The stator 21 is set on the rear side of the top surface of the horizontal part 11*d* and in parallel with the rail part 12, and includes an iron core 21*a* and a coil (not shown). The iron core 21*a* includes a slim base part, and a plurality of protrusions formed with an interval kept therebetween in the left-right direction on the top surface of the base part. The stator 21 is formed in the following manner. A coil is wound around each protrusion of the iron core 21*a*. The iron core 21*a* in that state is sealed with a sealing material 21*b* with the top surfaces of the protrusions exposed. The coil of the stator 21 is connected to the connector 25*a*. Further, to the portion of the slide table 23 opposed to the stator 21, there is attached a mover 22 including a plurality of permanent magnets arranged in the left-right direction such that N poles and S poles are alternately situated.

The substrate 24 is removably mounted to the front part of the base part 11. On the surface thereof, there are set various electronic components and the like for operating the linear motor type transport device 10. The substrate 24 is connected to the connector 25*b*. Further, the connectors 25*a* and 25*b* are connected via control units including a CPU, a storage device, and the like to a power source. Energization of the coil generates a magnetic field (N pole, S pole). Between the magnetic field and the N poles and the S poles of the permanent magnets, an attractive force and a repulsive force are generated, resulting in generation of a driving force. The slide table 23 moves along the rail part 12 by the driving force.

As described up to this point, in the connection structure A of the linear motor type transport devices in accordance with the present embodiment, in order to linearly connect a plurality of linear motor type transport devices 10 and 10*a*, the positioning member 13, the positioning support member 14, and the wedge member 15 are used. In addition, the first concave part 17A and the second concave part 17B forming the notch concave part 17 are included in the top surface of the base part 11. Then, the positioning member 13 is set between the wall part 17*a* of the notch concave part 17 and the rail parts 12, and regulates the butted two rail parts 12 to be linear. The positioning support member 14 regulates the bottom surfaces of the two rail parts 12 to be on the same plane, and regulates the rear parts of the two rail parts 12 to be linear.

The wedge member 15 presses the positioning support member 14 toward the positioning member 13, which causes the two rail parts 12 and the two base parts 11 to be linear, respectively. Accordingly, the adjacent two linear motor type transport devices 10 and 10*a* are set linearly. Further, the positioning member 13 and the wall part 17*a*, the rail parts 12 and the positioning support member 14, and the wedge member 15 and the bottom part of the notch concave part 17 are fixed by the screws 16*a*, 16*b*, and 16*c*, respectively. Therefore, respective members can be fixed with simplicity and reliability. Further, in the positioning part 14*b*, the inclined surface 14*e* is provided. In the wedge member 15, the inclined surface 15*a* is provided. Accordingly, the wedge member 15 is thrust from above into between the wall part 17*b* and the positioning support member 14. As a result, the positioning support member 14 moves toward the positioning member 13 in such a manner that both the inclined surfaces 14*e* and 15*a* slide on each other. Therefore, the positioning support member 14 can be situated at a proper position to fix the ends of the rail parts 12.

Further, it is configured such that the wedge member 15 is set only in the first concave part 17A of the linear motor type transport device 10 of the two linear motor type transport devices 10 and 10*a* to be connected. For this reason, even when errors are caused in dimensions between the first concave part 17A and the second concave part 17B, and between the rail parts 12 of the two linear motor type transport devices 10 and 10*a* to be connected, the portion to be pressed by the wedge member 15 is the portion of the positioning support member 14 situated in the first concave part 17A of the linear motor type transport device 10. Accordingly, an undue force will not be applied to the wall part 17*b* of the second concave part 17B of the linear motor type transport device 10*a*. This prevents the following: an undue force is applied to damage the linear motor type transport device 10*a* or the positioning support member 14.

Second Embodiment

Figure 16:
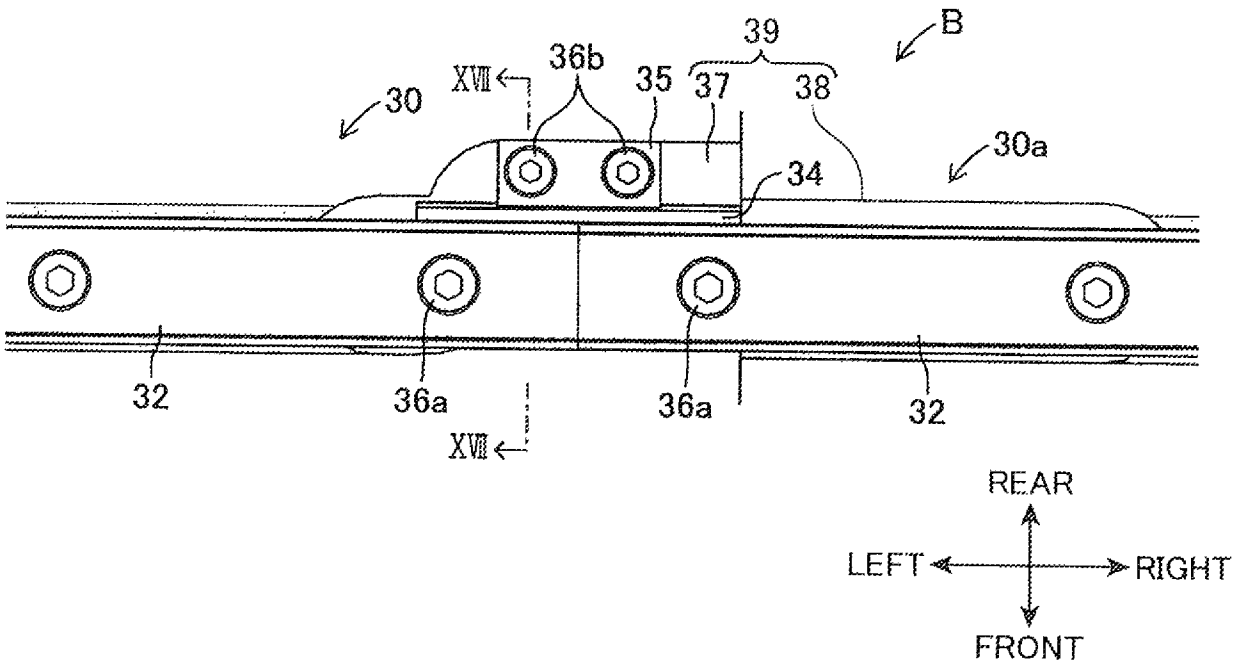
FIG. 16 is a plane view showing an essential part of the connection structure of linear motor type transport devices in accordance with a second embodiment of the present invention.
Figure 17:
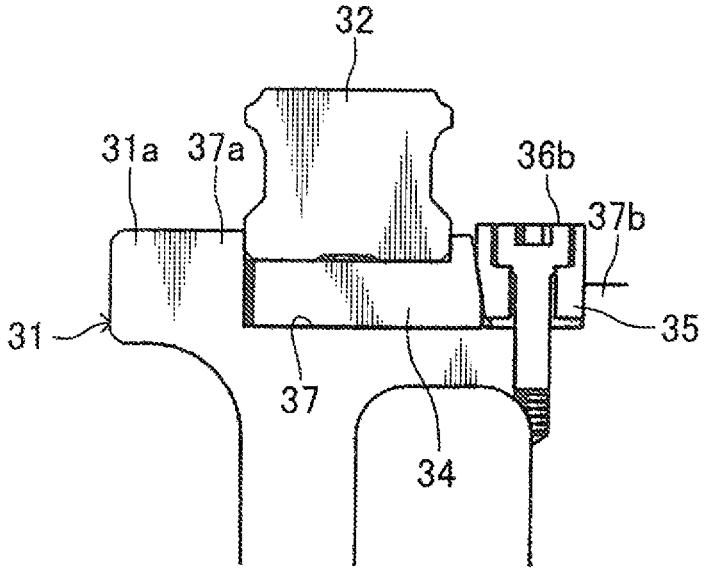
FIG. 17 is a cross-sectional view along line XVII-XVII of FIG. 16.

FIG. 16 shows an essential part of a connection structure B of linear motor type transport devices in accordance with a second embodiment of the present invention. FIG. 17 shows a cross section along line XVII-XVII of FIG. 16. The connection structures B of linear motor type transport devices include a plurality of linearly connected linear motor type transport devices 30 and 30*a* (first and second linear motor type transport devices), and the like having the same structure. FIG. 16 shows the connection part between the linear motor type transport device 30 and the linear motor type transport device 30*a* of them. The main body portions of the linear motor type transport devices 30 and 30*a* each include a base part 31, and a rail part 32 set on the top surface of the base part 31. Further, the ends of the linear motor type transport devices 30 and 30*a* are connected by a positioning support member 34, a wedge member 35, and a plurality of screws 36*a* and 36*b* shown in FIG. 18.

Figure 18:
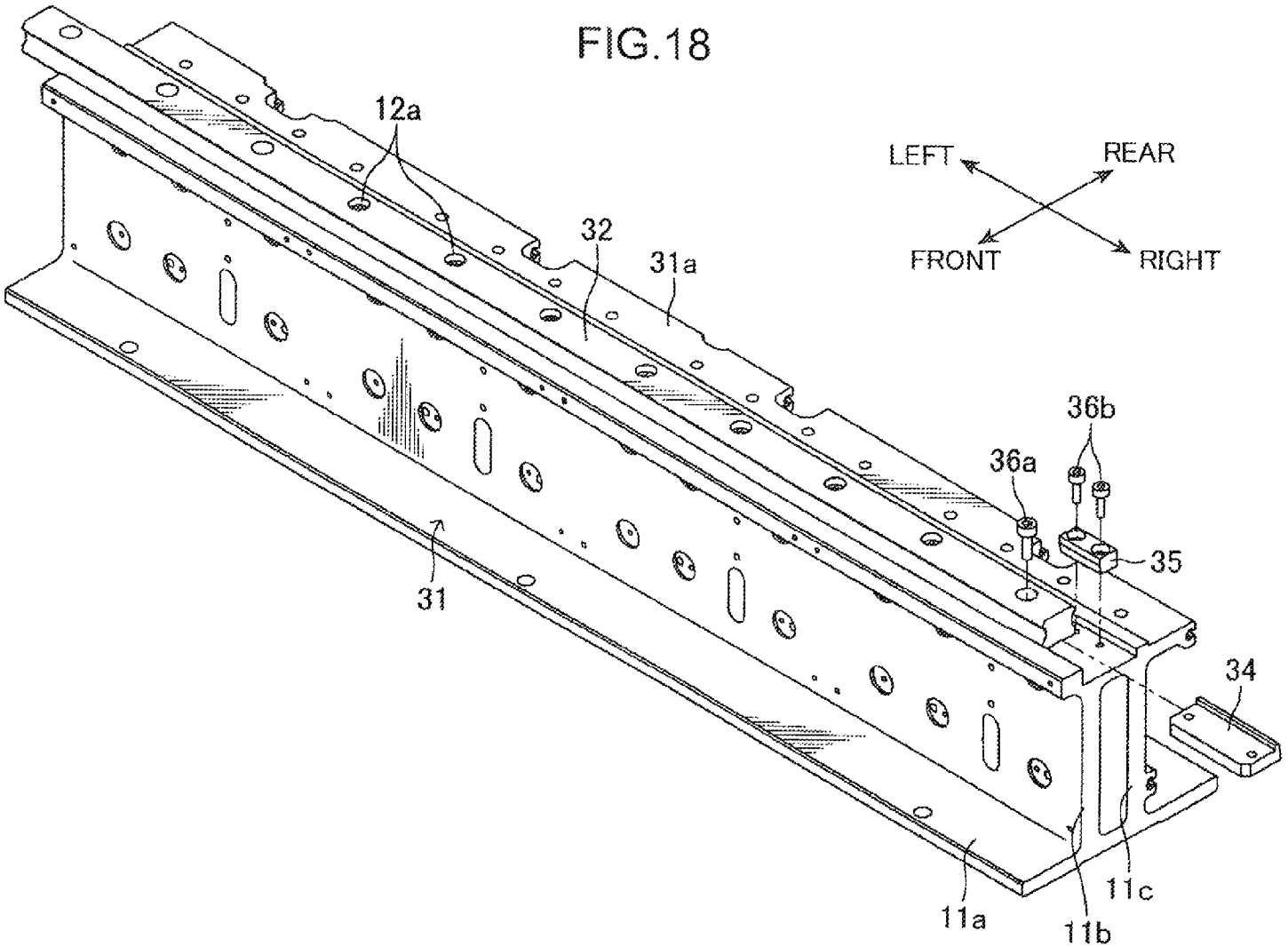
FIG. 18 is a perspective view showing an exploded state of an essential part of the linear motor type transport device in accordance with the second embodiment.
Figure 19:
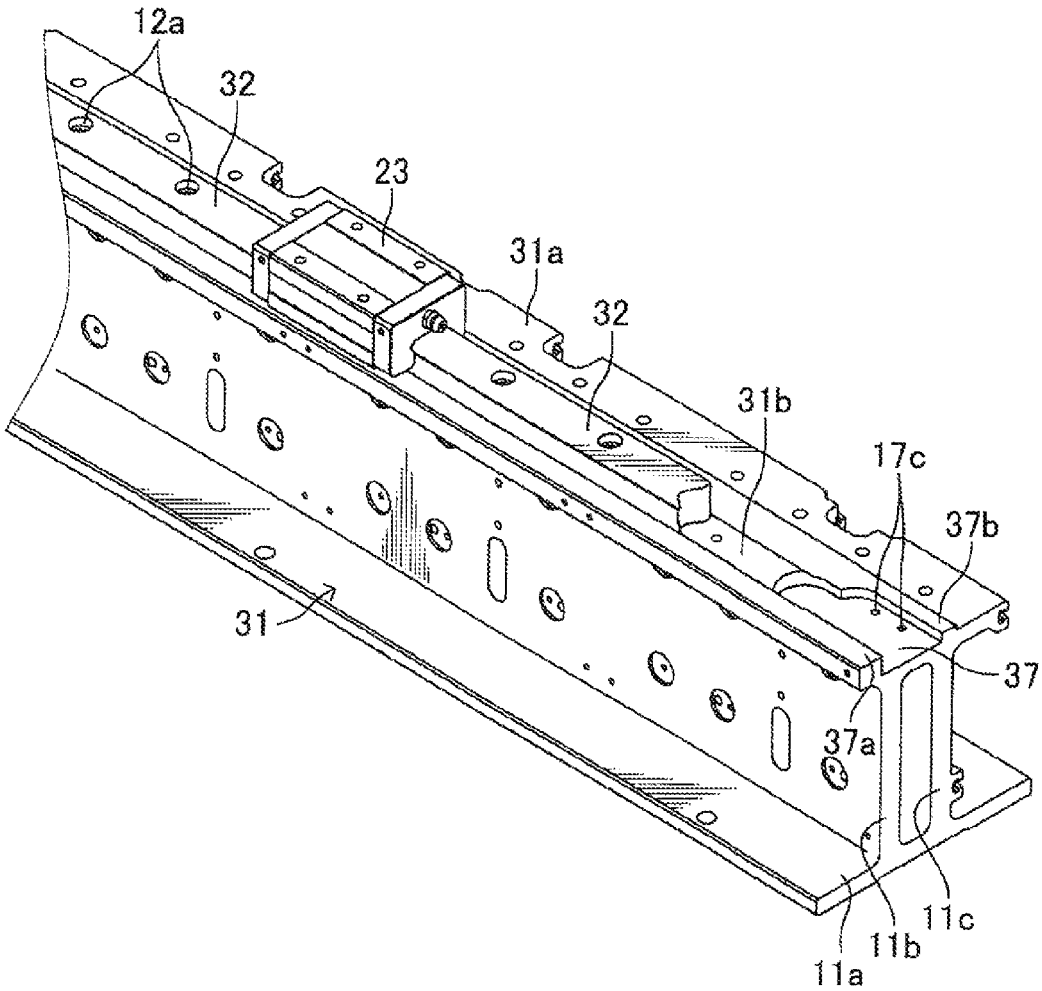
FIG. 19 is a perspective view showing a notch concave part formed in a base part of the linear motor type transport device in accordance with the second embodiment.
Figures 20A, 20B, 20C, 20D:
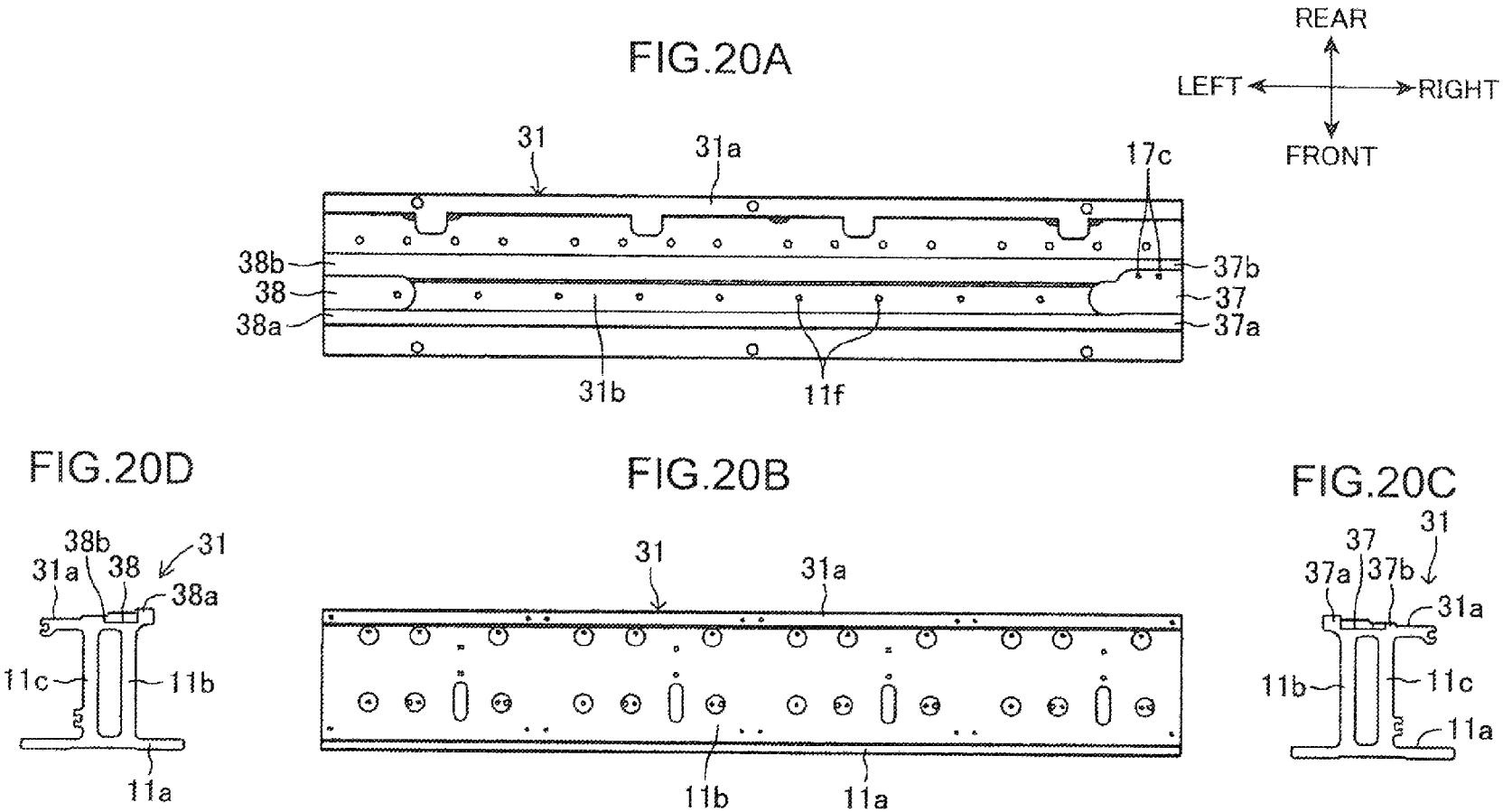

In the base part 31, as shown in FIGS. 18 to 20, on the front side of the top surface of a horizontal part 31*a* forming the top surface part, there is formed a rail setting part 31*b* extending from left to right. On the right end (first end face) side of the rail setting part 31*b*, a shallowly recessed first concave part 37 is formed; and on the left end (second end face) side, a shallowly recessed second concave part 38 is formed. When the other linear motor type transport device 30*a* is connected to the right end of the linear motor type transport device 30, the first concave part 37 is connected with the second concave part 38 included in the other linear motor type transport device 30*a*, resulting in the formation of one notch concave part 39. Similarly, the second concave part 38 is connected with a first concave part 37 included in a still other linear motor type transport device, resulting in the formation of one notch concave part 39.

The first concave part 37 is provided at the right end of the horizontal part 31*a*, and is a width-varying concave part in which the portion situated on the end side is larger in width than the portion on the recess side in the left-right direction. The front-rear width of the portion on the end side of the first concave part 37 is larger than the width of the rail setting part 31*b*. The rear part of the portion protrudes toward the outside of the rail setting part 31*b*. Further, the width of the portion on the recess side of the first concave part 37 is slightly larger than the width of the rail setting part 31*b*. Only the rear part thereof protrudes toward the outside of the rail setting part 31*b*.

The front part of the first concave part 37 linearly extends along the rail setting part 31*b*. At the front and rear of the first concave part 37, there are formed wall parts 37*a* and 37*b*, respectively. The inner surface of the wall part 37*a* formed at the front part forms a reference positioning part in accordance with the present invention. The second concave part 38 is provided at the left end of the horizontal part 31*a*, and linearly extends along the rail setting part 31*b*. In the second concave part 38, the front part thereof is situated slightly ahead of the front part of the rail setting part 31*b*, and the rear part thereof is situated slightly behind the rear part of the rail setting part 31*b*. The second concave part 38 is larger in width than the rail setting part 31*b* by that much. Further, at the front and rear opposite sides of the second concave part 38, there are formed wall parts 38*a* and 38*b* forming the wall parts in accordance with the present invention, along with the wall parts 37*a* and 37*b* of the first concave part 37.

The rail part 32 is the same as the rail part 12. However, when the rail part 32 is fixed to the rail setting part 31*b*, the lower edge of the front part of the right-hand end side portion is along the inner surface of the wall part 37*a*. In addition, the lower edge of the front part of the left-hand end side portion is along the inner surface of the wall part 38*a* with a slight interval kept from the wall part 38*a*. Incidentally, the base part 31 is equal in length to the rail part 32. However, the right end of the rail part 32 is situated inwardly of the right end of the base part 31, and the left end of the rail part 32 protrudes externally of the left end of the base part 31. Accordingly, when the linear motor type transport devices 30 and 30*a* are assembled, the border part between both the rail parts 32 is situated in the first concave part 37 of the linear motor type transport device 30 in the notch concave part 39.

The positioning support member 34, the wedge member 35, and the screws 36*a* and 36*b* are equal in configuration to the positioning support member 14, the wedge member 15, and the screws 16*b* and 16*c*, respectively. Therefore, a description thereon will be omitted. Further, other portions forming the connection structure B of the linear motor type transport devices are also equal in configuration to the connection structure A of the linear motor type transport devices in accordance with the first embodiment. Therefore, the same portions are given the same reference numerals and signs, and a description thereon will be omitted.

In this configuration, when the linear motor type transport device 30 and the linear motor type transport device 30*a* are assembled, a worker first causes the ends of the linear motor type transport device 30 and the linear motor type transport device 30*a* to abut against each other with the positioning support member 34 inserted into the first concave part 37 of the linear motor type transport device 30. Then, the worker moves the positioning support member 34 rightward, so that the center thereof in the left-right direction is situated at the border between the rail parts 32 of the linear motor type transport device 30 and the linear motor type transport device 30*a*. At this step, the right end of the positioning support member 34 is situated at the border between the base parts 32 of the linear motor type transport device 30 and the linear motor type transport device 30*a*. Then, the worker lightly fixes the positioning support member 34 to respective rail parts 32 of the linear motor type transport device 30 and the linear motor type transport device 30*a* by two screws 36*a*.

In that state, the wedge member 35 is set between the wall part 37*b* of the linear motor type transport device 30 and the positioning support member 34, and is fixed to the bottom surface of the first concave part 37 (notch concave part 39) by two screws 36*b*. This case results in that the center in the left-right direction of the wedge member 35 is situated at the border between the two rail parts 32. Then, the two screws 36*a* mounted to both the rail parts 32 and the positioning support member 34 are firmly fastened. This results in the completion of the work of connecting the linear motor type transport device 30 and the linear motor type transport device 30*a*. Further, to the end of the linear motor type transport device 30*a*, another linear motor type transport device is also similarly connected. Further, to the end of the linear motor type transport device, a still other linear motor type transport device is sequentially connected.

As described up to this point, in the connection structure B of linear motor type transport devices in accordance with the present embodiment, in order to linearly connect the linear motor type transport devices 30 and 30*a*, in the top surfaces of the base parts 31, the first concave part 37 and the second concave part 38 (notch concave part 39) are formed. Then, at the front part of the first concave part 37, there is formed the wall part 37*a* (positioning wall surface part) serving as a reference positioning part. In addition, in the first concave part 37, there are set the positioning support member 34 (bottom surface support part) and the wedge member 35 (a part of a pressing member). In this case, the wall part 37*a* regulates the front-side lower edges of the two rail parts 32 (first and second rail parts) to be linear. Then, the positioning support member 34 regulates the bottom surfaces of the two rail parts 32 to be situated on the same plane, and regulates the lower edges of the rear parts of the two rail parts 32 to be linear. Further, the wedge member 35 presses the positioning support member 34 toward the wall part 37*a*, thereby makes respective base parts 31, and respective rail parts 32 linear, respectively.

For this reason, in accordance with the present embodiment, a member for regulating the front-side lower edges of the two rail parts 32 to be linear is not required to be additionally provided. This reduces the number of components, which results in simplification of the structure of the connection structure B of linear motor type transport devices, and can reduce the cost. Further, in the present embodiment, the positioning support member 34 and the wedge member 35 are set so as to be situated in the inside of the first concave part 37 of the linear motor type transport device 30 in which the border between the two rail parts 32 is situated. This results in that a pressing force is evenly applied to both opposing ends of the two rail parts 32 to be connected. This allows connection between the two linear motor type transport devices 30 and 30*a* in good balance. Other advantageous effects of the connection structure B of linear motor type transport devices are the same as the advantageous effects of the connection structure A of linear motor type transport devices.

Third Embodiment

Figure 21:
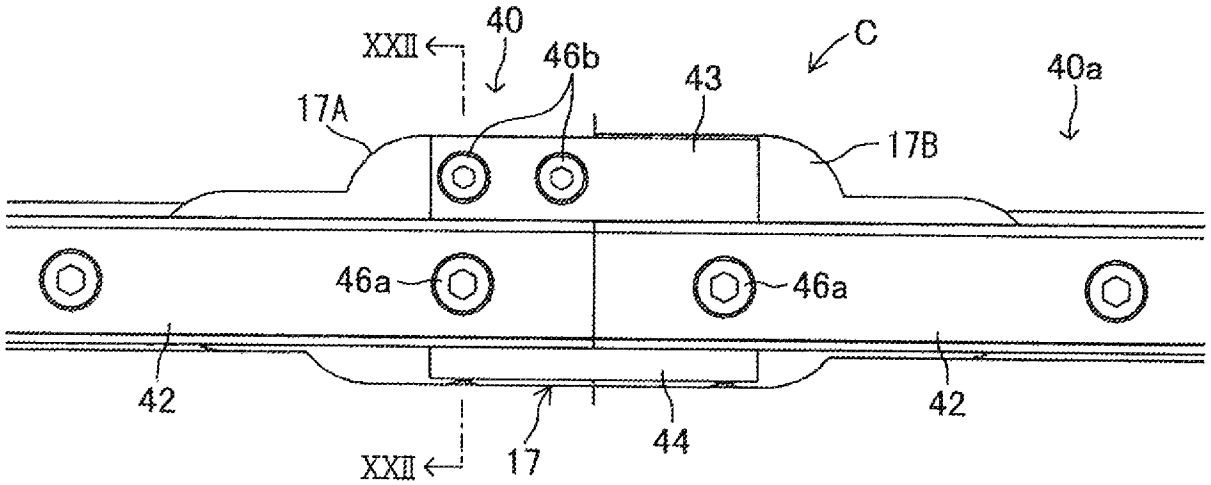
FIG. 21 is a plane view showing an essential part of a connection structure of linear motor type transport devices in accordance with a third embodiment.
Figure 22:
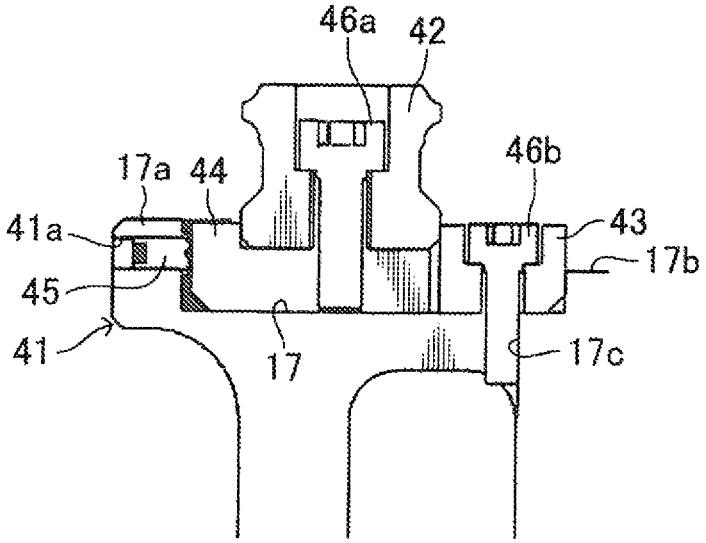
FIG. 22 is a cross-sectional view along line XXII-XXII of FIG. 21.
Figure 23:
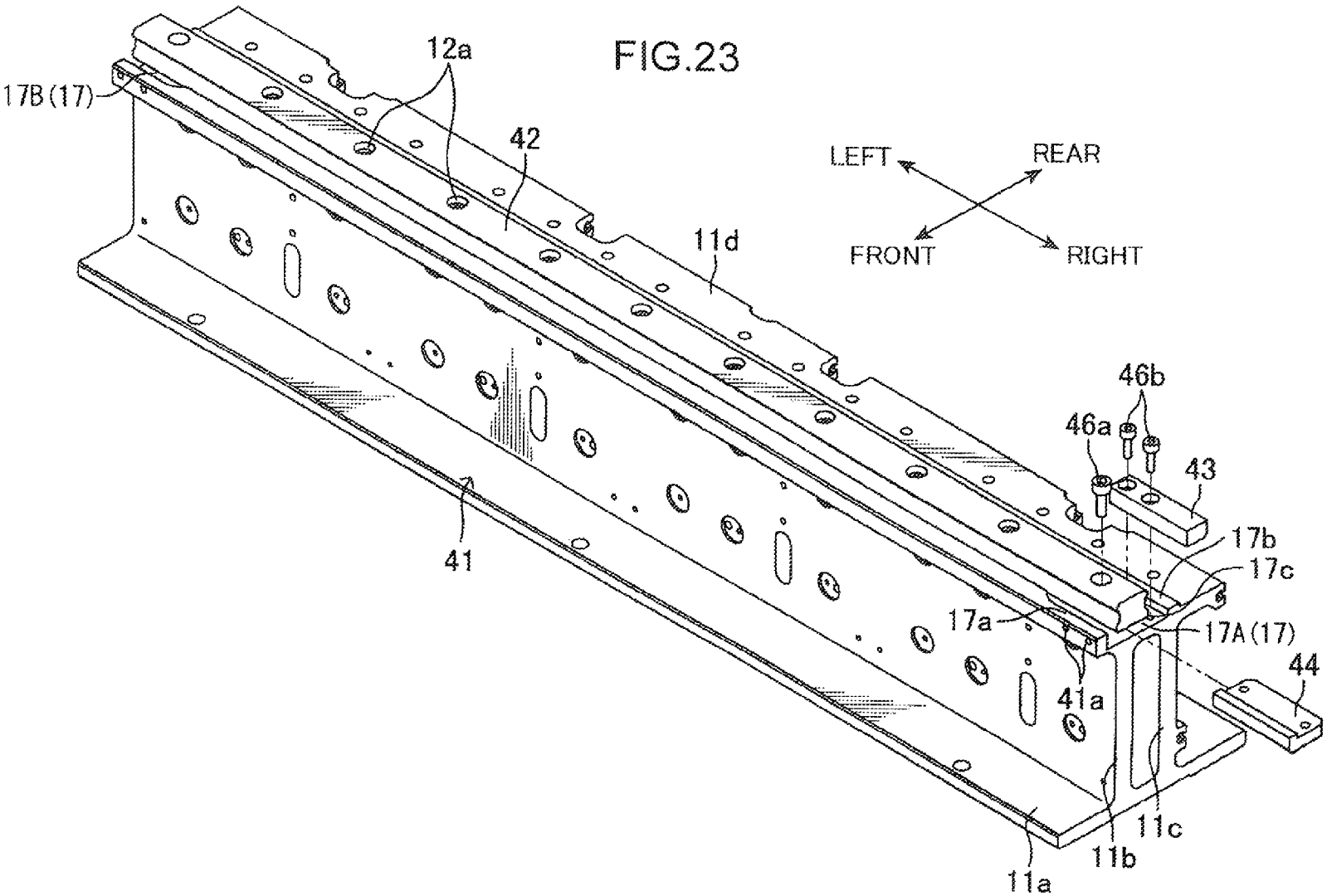
FIG. 23 is a perspective view showing an exploded state of an essential part of the linear motor type transport device in accordance with the third embodiment.

FIG. 21 shows an essential part of a connection structure C of linear motor type transport devices in accordance with a third embodiment of the present invention. FIG. 22 shows a cross section along line XXII-XXII of FIG. 21. The connection structure C of linear motor type transport devices includes a plurality of linearly connected linear motor type transport devices 40, 40*a* (first and second linear motor type transport devices), and the like having the same structure. FIG. 21 shows the connection part between the linear motor type transport device 40 and the linear motor type transport device 40*a* of them. The main body portions of the linear motor type transport devices 40 and 40*a* each include a base part 41, and a rail part 42 set on the top surface of the base part 41. Further, the ends of the linear motor type transport devices 40 and 40*a* are connected by a positioning member 43 (reference positioning part), a positioning support member 44 (bottom surface support part), a set screw 45 (a part of a pressing member; see FIG. 22), and a plurality of screws 46*a* and 46*b* shown in FIG. 23. Incidentally, in the present embodiment, the front side in FIG. 23 is referred to as the other side in accordance with the present invention, and the rear side is referred to as one side in accordance with the present invention. Namely, the reference position is situated on the rear side.

The base part 41 is provided with tapped holes 41*a* (a part of a pressing member) in accordance with the present invention in place of the through holes 11*g* included in the linear motor type transport device 10 in the first embodiment. As for other portions, the base part 41 has the same configuration as that of the base part 11 included in the linear motor type transport device 10 in the first embodiment. Further, the rail part 42 is also equal to the rail part 12 included in the linear motor type transport device 10 in the first embodiment. Therefore, respective portions forming the base part 41 and the rail part 42 are given the same numerals and signs, and a description thereon will be omitted.

Figure 24A:
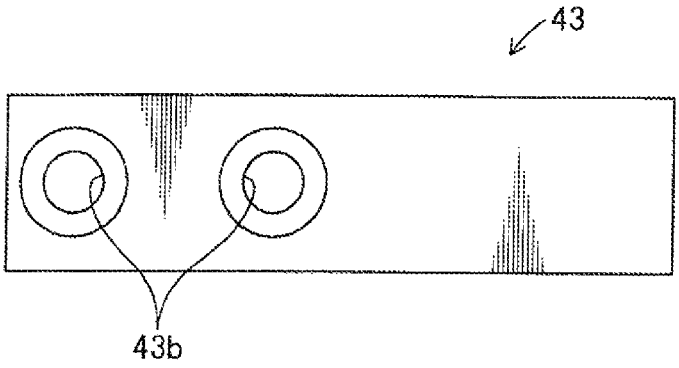
Figure 24B:
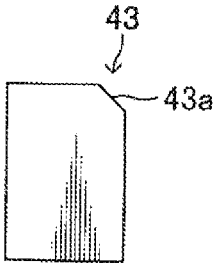

FIG. 24A shows a plane of the positioning member 43. FIG. 24B shows a side surface of the positioning member 43. As shown, the positioning member 43 has a shape of a slim tetragonal rod body extending from left to right. The corner part between the rear surface and the bottom surface includes an inclined surface 43*a*, and the width in the front-rear direction is longer than the length in the vertical direction. In the left-hand side portion of the positioning member 43, a pair of vertically penetrating tapped holes 43*b* are formed with an interval kept therebetween.

Figure 25A:
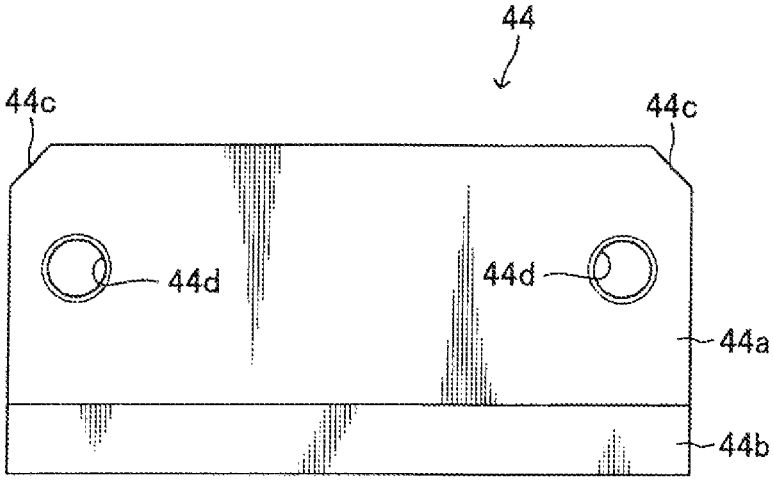
Figure 25B:
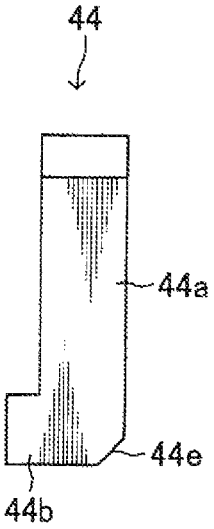

Further, FIG. 25A shows a plane of the positioning support member 44. FIG. 25B shows a side surface of the positioning support member 44. As shown, the positioning support member 44 includes a support part 44*a* (bottom surface support part) in the shape of a generally tetragonal plate, and a positioning part 44*b* provided at the front part of the support part 44*a*, and having a top part protruding above the top surface of the support part 44*a*. The side surface of the positioning support member 44 is in a generally L-shaped form. The width in the front-rear direction of the entire positioning support member 44 is set larger than the width of the rail part 42. The width in the front-rear direction of the support part 44*a* is set slightly smaller than the width of the rail part 42.

Accordingly, when at the bottom surface of the rail part 42, the support part 44*a* is situated, the rear edge of the rail part 42 protrudes slightly rearward from the rear end of the support part 44*a*. The length in the left-right direction of the positioning support member 44 is set at a length allowing accommodation thereof in the notch concave part 17. Further, the corner parts on the opposite sides of the rear part of the support part 44*a* each include an inclined surface 44*c*. In the center portion in the front-rear direction on the opposite left and right sides of the support part 44*a*, vertically penetrating tapped holes 44*d* are formed, respectively. Further, the corner part between the front surface and the bottom surface of the positioning support member 44 includes an inclined surface 44*e*.

The total length of the width in the front-rear direction of the positioning support member 44 and the width in the front-rear direction of the positioning member 43 is smaller than the width in the front-rear direction of the end side portion of the notch concave part 17. Accordingly, when the positioning member 43 and the positioning support member 44 are disposed in the notch concave part 17, clearances are caused between the wall parts 17*a* and 17*b* of the notch concave part 17. Further, a set screw 45 includes a screw member capable of being screwed into the tapped hole 41*a* of the horizontal part 11*d*. The configurations of other portions forming the connection structure C of linear motor type transport devices are the same as those of the connection structure A of linear motor type transport devices in accordance with the first embodiment. Therefore, a description thereon will be omitted.

In this configuration, when the linear motor type transport device 40 and the linear motor type transport device 40*a* are assembled, a worker first causes the ends of the linear motor type transport device 40 and the linear motor type transport device 40*a* to abut against each other with the positioning support member 44 inserted into the first concave part 17A of the linear motor type transport device 40. Then, the worker sets the positioning member 43 between the wall part 17*b* of the notch concave part 17 and the rail part 42 with the center in the left-to-right direction situated at the border between the linear motor type transport device 40 and the linear motor type transport device 40*a*. Thus, the positioning member 43 is firmly fixed to the horizontal part 11*d* of the linear motor type transport device 40 by two screws 46*b*. The front side surface of the positioning member 43 serves as a reference positioning part in accordance with the present invention.

Then, the positioning support member 44 is moved rightward, so that the center in the left-right direction is situated at the border between the linear motor type transport device 40 and the linear motor type transport device 40*a*. Then, the positioning support member 44 is lightly fixed to both the rail parts 42 of the linear motor type transport devices 40 and 40*a* by two screws 46*a*. In that state, two set screws 45 are screwed from the front surface side toward the inner surface of the wall part 17*a* into the tapped holes 41*a* of the linear motor type transport devices 40 and 40*a*. This presses the positioning support member 44 rearward. As a result, the positioning part 44*b* of the positioning support member 44 presses the ends of both the rail parts 42 rearward. Accordingly, the ends of both the rail parts 42 are pressed against the positioning member 43.

Then, the two screws 46*a* mounted to both the rail parts 42 of the linear motor type transport devices 40 and 40*a* and the positioning support member 44 are firmly fastened. This results in the completion of the work of connecting the linear motor type transport device 40 and the linear motor type transport device 40*a*. Further, to the end of the linear motor type transport device 40*a*, another linear motor type transport device is also similarly connected. Further, to the end of the linear motor type transport device, a still other linear motor type transport device is sequentially connected.

As described up to this point, in the connection structure C of linear motor type transport devices in accordance with the present embodiment, in order to linearly connect the linear motor type transport devices 40 and 40*a*, in the top surfaces of the base parts 41, the notch concave part 17 is formed. In addition, there are formed the tapped holes 41 a penetrating from the outer surface of the horizontal part 11*d* through the notch concave part 17. Then, in the notch concave part 17, there are set the positioning member 43 and the positioning support member 44. Thus, the set screws 45 are screwed into the tapped holes 41*a*. In this case, the positioning member 43 regulates the rear-side lower edges of the two rail parts 42 to be linear. Then, the positioning support member 44 regulates the bottom surfaces of the two rail parts 42 to be situated on the same plane, and regulates the lower edges of the front parts of the two rail parts 42 to be linear. Further, the set screws 45 press the positioning support member 44 toward the support member 43, thereby makes respective base parts 41, and respective rail parts 42 linear, respectively.

In accordance with the present embodiment, by adjusting the screwing amount of each set screw 45, it becomes possible to render fixation of the rail parts 32 in a proper state. This facilitates the adjustment of the pressing force. Further, it is not necessary to form the tapered surface for wedge in the positioning support member 44. This simplifies manufacturing of the positioning support member 44. Further, in the present embodiment, the positioning member 43 and the positioning support member 44 are set so as to be situated in the insides of both the first concave part 17A and the second concave part 17B of the linear motor type transport devices 40 and 40*a*. The set screws 45 are screwed into both the tapped holes 41*a* of the linear motor type transport device 40 and the linear motor type transport device 40*a*. This results in that a pressing force is evenly applied to the two rail parts 42 to be connected. This allows connection between the two linear motor type transport devices 40 and 40*a* in good balance.

Other advantageous effects of the connection structure C of linear motor type transport devices are the same as the advantageous effects of the connection structure A of linear motor type transport devices. Further, the connection structure of the linear motor type transport devices in accordance with the present invention is not limited to the respective embodiments, and can be appropriately changed within the technical scope of the present invention.

Incidentally, the foregoing specific embodiments mainly include the inventions having the following constitutions.

A connection structure (A, B, or C) of a linear motor type transport device in accordance with one aspect of the present invention, including:

a first linear motor type transport device (10, 30, or 40) including a first base part (11, 31, or 41), and a first rail part (12, 32, or 42) set on the top surface of the first base part, and having a first end face for connection;

a second linear motor type transport device (10*a*, 30*a*, or 40*a*) including a second base part (11, 31, or 41), and a second rail part (12, 32, or 42) set on the top surface of the second base part, and having a second end face to be butt-connected to the first end face;

a notch concave part (17, 37, or 38) including a first concave part and a second concave part included in the top surfaces of the end on the first end face side of the first base part, and the end on the second end face side of the second base part, respectively, with the first concave part and the second concave part being connected to each other, and the notch concave part being configured to have a width larger than each width of the first and second rail parts;

a reference positioning part (13, 37*a*, or 43) serving as a reference position of each of lower edges on one side, in the width direction, of the first and second rail parts;

a bottom surface support part (14*a* or 44*a*) disposed in the notch concave part, and set between the bottom surface of the notch concave part and the bottom surfaces of the first and second rail parts; and a pressing member (14*b*, 15, 35, 41*a*, 44*b*, or 45) interposed between the wall part (17*a* or 17*b*) of the notch concave part and lower edges on the other side of the first and second rail parts, for urging the lower edges on the other-side of the first and second rail parts toward the reference positioning part, and thereby linearly fixing the first and second linear motor type transport devices to be connected.

In the connection structure of the linear motor type transport devices in accordance with the present invention, in order to linearly connect respective linear motor type transport devices, there are used the reference positioning part, the bottom surface support part, and the pressing member. In addition, in the top surfaces of the base parts, there are formed the first concave part and the second concave part (notch concave part) for setting the respective parts therein. The reference positioning part regulates the lower edges on one side (the corner parts between the side surfaces and the bottom surfaces, and the neighboring portions) in the width direction of the two rail parts to be in the form of a straight line along the wall part on one side of the notch concave part. The bottom surface support part regulates the bottom surfaces of the two rail parts to be on the same plane. Then, the pressing member urges the lower edges on the other side of the rail parts toward the reference positioning part, and thereby causes respective base parts and respective rail parts to be linear, respectively. As a result, the adjacent two linear motor type transport devices are connected linearly, respectively.

Incidentally, the overall width of the notch concave part is not required to be larger than the width of the rail part. It is essential only that the portion for setting therein the reference positioning part, the bottom surface support part, and the pressing member has a larger width than the width of the rail part. Further, those forming the reference positioning part, the bottom surface support part, and the pressing member are not required to each include a different member or the like, and may include an integral member including a plurality of portions. In short, it is essential only that there are included a portion for regulating a position on one side in the width direction of the rail part, a portion for supporting the bottom surface of the rail part, and a member for pressing the rail part toward the reference positioning part.

Further, a feature of another configuration of the connection structure of a linear motor type transport device in accordance with the present invention resides in the following configuration. The connection structure further includes: a positioning member (13) disposed on one side in the width direction of a notch concave part (17), and set between the wall part (17*a*) on one side of the notch concave part and the lower edges on one side of the first and second rail parts (12); a positioning support member (14) including a support part (14*a*) disposed on the center side in the width direction of the notch concave part, and set between the bottom surface of the notch concave part and the bottom surfaces of the first and second rail parts, and a positioning part (14*b*) set along the lower edges on the other side of the rail parts; and a wedge member (15) disposed on the other side in the width direction of the notch concave part, for being thrust into between the wall part (17*b*) on the other side of the notch concave part and the positioning support member, thereby urging the positioning support member toward the positioning member. The reference positioning part includes the portion of the positioning member to abut against the first and second rail parts; the support part includes the bottom surface support part; and the pressing member includes the positioning member and the wedge member.

In the connection structure of a linear motor type transport device in accordance with the present invention, in order to linearly connect respective linear motor type transport devices, three members of the positioning member, the positioning support member, and the wedge member are used. In addition, in the top surfaces of the base parts, there is formed the notch concave part for setting the members therein. Out of these members, the positioning member is set between the wall part on one side of the notch concave part and the rail parts, and regulates the lower edges on one side of the first and second rail parts to be in a straight line along the wall part on one side of the notch concave part. The positioning support member includes the support part and the positioning part. The support part regulates the bottom surfaces of the first and second rail parts to be on the same plane. The positioning part regulates the lower edges on the other side of the first and second rail parts to be linear.

Then, the wedge member is thrust into between the wall part on the other side of the notch concave part and the positioning support member, and presses the positioning support member toward the positioning member. As a result, the positioning member and the positioning part interpose the rail parts therebetween, so that respective base parts and respective rail parts become linear, respectively. This linearly connects the adjacent first and second linear motor type transport devices, respectively. In this case, a clearance is caused between the positioning support member and the positioning member. This allows the positioning support member to move toward the positioning member when the positioning support member is pressed by the wedge member. Further, preferably, the surfaces of the positioning member opposing the wall part on one side of the rail parts, and the surface of the positioning support member opposing the rail parts are each formed in a plane without unevenness or distortion.

Further, a feature of another configuration of the connection structure of a linear motor type transport device in accordance with the present invention resides in the following configuration. The positioning member and the wall part of the notch concave part, the first and second rail parts and the support part, and the wedge member and the bottom part of the notch concave part are fixed by screws (16*a*, 16*b*, and 16*c*), respectively. This can achieve fixing between respective members with simplicity and reliability.

Still further, a feature of a still other configuration of the connection structure of a linear motor type transport device in accordance with the present invention resides in the following configuration. The surface of the positioning support member to be in contact with the wedge member includes an inclined surface (14*e*) inclined in a direction of heading gradually farther away from the side, on which the wedge member is situated, as this surface heads gradually from the bottom side toward the top side; and the surface of the wedge member to be in contact with the positioning support member includes an inclined surface (15*a*) inclined in a direction of heading gradually farther away from the side, on which the positioning support member is situated, as this surface heads gradually from the top side toward the bottom side.

With this configuration, the wedge member is thrust from above into between the wall part of the notch concave part and the positioning part. As a result, the positioning support member moves toward the positioning member in such a manner that both the inclined surfaces slide on each other. Accordingly, the positioning support member can be situated at a proper position to fix the ends of the rail parts. Namely, in the present invention, with the surface of the positioning member opposing the rail parts as a reference position, the rail parts are pressed against the positioning member. This enables proper connection. Further, the operation for adjusting the position is only to thrust the wedge member into between the wall part of the notch concave part and the positioning part, and hence is easy.

Furthermore, a feature of a furthermore configuration of the connection structure of a linear motor type transport device in accordance with the present invention resides in the following configuration. The wedge member is set in any one concave part of the first concave part and the second concave part. With this configuration, even when errors are caused in dimensions between the notch concave parts and between the rail parts of the first and second linear motor type transport devices to be connected, the portions to be pressed by the wedge member are the wall part of the notch concave part of any linear motor type transport device and the portion of the positioning part situated in the notch concave part. Accordingly, an undue force will not be applied to the wall part. This prevents the following: an undue force is applied to damage the linear motor type transport device or the positioning support member.

Further, a feature of a still other configuration of the connection structure of a linear motor type transport device in accordance with the present invention resides in the following configuration. The connection structure further includes: a positioning wall surface part (37*a*) formed at the wall part on one side of a notch concave part (39) such that the lower edges on one side of the first and second rail parts (32) can be therealong; a positioning support member (34) disposed in the notch concave part, and including a support part disposed between the bottom surface of the notch concave part and the bottom surfaces of the first and second rail parts, and a positioning part disposed along lower edges on the other side of the first and second rail parts; and a wedge member (35) disposed on the other side in the width direction of the notch concave part, for being thrust into between the wall part on the other side of the notch concave part and the positioning support member, thereby urging the positioning support member toward the positioning wall surface part. The reference positioning part includes the positioning wall surface part; the bottom surface support part includes the support part; and the pressing member includes the positioning part and the wedge member.

In the connection structure of a linear motor type transport device in accordance with the present invention, in order to linearly connect respective linear motor type transport devices, the positioning wall surface part, the positioning support member, and the wedge member are used. In addition, in the top surfaces of the base parts, the notch concave part is formed. The positioning wall surface part is formed at the wall part on one side of the notch concave part, and regulates the lower edges on one side of the first and second rail parts to be linear. The positioning support member includes the support part and the positioning part. The support part regulates the bottom surfaces of the first and second rail parts to be on the same plane. The positioning part regulates the lower edges on the other side of the first and second rail parts to be linear.

Then, the wedge member is thrust into between the wall part on the other side of the notch concave part and the positioning support member, and presses the positioning support member toward the positioning member. As a result, the positioning member and the positioning part interpose the rail parts therebetween, so that respective base parts and respective rail parts become linear, respectively. This linearly connects the adjacent first and second linear motor type transport devices, respectively. In this case, a clearance is caused between the positioning support member and the positioning wall surface part. This allows the positioning support member to move toward the positioning wall surface part when the positioning support member is pressed by the wedge member. Further, preferably, the surface of the positioning wall surface part opposing the first and second rail parts, and the surface of the positioning support member opposing the first and second rail parts are each formed in a plane without unevenness or distortion.

Further, in the present invention, the first and second rail parts and the support part, and the wedge member and the bottom part of the notch concave part are preferably fixed by screws (36*a* and 36*b*), respectively. This can fix the rail parts and the support part, and the wedge member and the bottom part of the notch concave part with simplicity and reliability.

Further, in the present invention, preferably, the surface of the positioning support member to be in contact with the wedge member includes an inclined surface inclined in a direction of heading gradually away from the side, on which the wedge member is situated, as this surface head gradually from the bottom side toward the top side; and the surface of the wedge member to be in contact with the positioning support member includes an inclined surface inclined in a direction of heading gradually away from the side, on which the positioning support member is situated, as this durface heads gradually from the top side toward the bottom side.

With this configuration, the wedge member is thrust from above into between the wall part of the notch concave part and the positioning part. As a result, the positioning support member moves toward the positioning member in such a manner that both the inclined surfaces slide on each other. Accordingly, the positioning support member can be situated at a proper position to fix the ends of the rail parts. This results in that the positioning support member is pressed against the bottom part of the notch concave part by the wedge member, which ensures secure fixing.

Further, the wedge member and the positioning support member may be set so as to be situated in both of the first concave part and the second concave part of the first and second linear motor type transport devices to be connected, or may be set so as to be situated in any one of the first concave part and the second concave part. When the wedge member and the positioning support member are set in one concave part, it is configured such that the border between the base parts of the first and second linear motor type transport devices and the border between the first and second rail parts thereof are situated at different positions. This allows the wedge member and the positioning support member to press the ends of both the rail parts. As a result, it becomes possible to evenly apply a pressing force to the ends of the first and second rail parts to be connected. This allows connection between the first and second linear motor type transport devices in good balance.

Further, a feature of a still other configuration of the connection structure of a linear motor type transport device in accordance with the present invention resides in the following configuration. The connection structure further includes: a positioning member (43) disposed on one side in the width direction of a notch concave part (17), and set between the wall part (17*b*) on one side of the notch concave part and the lower edges on one side of the first and second rail parts (42); a positioning support member (44) including a support part (44*a*) disposed in the notch concave part, and set between the bottom surface of the notch concave part and the bottom surfaces of the first and second rail parts, and a positioning part (44*b*) set along lower edges on the other side of the rail parts; a tapped hole (41*a*) disposed in the wall part on the other side of the notch concave part, and penetrating through between the outer surface and the surface on the notch concave part side of the wall part (17*a*) on the other side; and a screw member (45) for being screwed from the outer surface of the wall part on the other side into the tapped hole, thereby urging the positioning support member toward the positioning member. The reference positioning part includes the portion of the positioning member to abut against the rail parts; the bottom surface support part includes the support part; and the pressing member includes the positioning part, the tapped hole, and the screw member.

In the connection structure of a linear motor type transport device in accordance with the present invention, in order to linearly connect respective linear motor type transport devices, the positioning member, the positioning support member, the tapped holes disposed in the wall part on the other side, and the screw members are used. In addition, in the top surfaces of the base parts, the notch concave part is formed. In this case, the positioning member is set between the wall part on one side of the notch concave part and the rail parts, and regulates the lower edges on one side of the first and second rail parts to be in a straight line along the wall parts on one side of the two notch concave parts. The positioning support member includes the support part and the positioning part. The support part regulates the bottom surfaces of the first and second rail parts to be on the same plane, and the positioning part regulates the lower edges on the other side of the first and second rail parts to be linear.

Then, each screw member is screwed into the tapped hole from the outer surface side of the wall part on the other side toward the notch concave part, and presses the positioning support member toward the positioning member. As a result, the positioning member and the positioning part interpose the first and second rail parts therebetween, so that respective base parts and respective rail parts become linear, respectively. This linearly connects the adjacent first and second linear motor type transport devices, respectively. In this case, a clearance is caused between the positioning support member and the positioning member. This allows the positioning support member to move toward the positioning member when the positioning support member is pressed by the wedge member. Further, preferably, the surfaces of the positioning member opposing the wall part on one side of the notch concave part and the first and second rail parts, and the surface of the positioning support member opposing the first and second rail parts are each formed in a plane without unevenness or distortion.

Further, in the present invention, the rail parts and the support part, and the positioning member and the bottom part of the notch concave part are fixed by the screws (46*a* and 46*b*), respectively. This can fix the positioning member and the bottom part of the notch concave part, and the rail parts and the support part with simplicity and reliability.

Further, in the present invention, preferably, the positioning member is set so as to be situated in both the concave parts of the first concave part and the second concave part, and the pressing member is disposed in the wall part on the other side of the notch concave part correspondingly to both of the first concave part and the second concave part. This results in that a pressing force is evenly applied to the two first and second rail parts to be connected. This allows connection between the first and second linear motor type transport devices in good balance.

This application is based on Japanese patent application Nos. 2010-227214 and 2010-268254, filed in Japan Patent Office on Oct. 7, 2010 and Dec. 1, 2010 respectively, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A connection structure of a linear motor type transport device, comprising:

a first linear motor type transport device including a first base part, and a first rail part disposed on a top surface of the first base part, and having a first end face for connection;

a second linear motor type transport device including a second base part, and a second rail part disposed on a top surface of the second base part, and having a second end face to be butt-connected to the first end face;

a notch concave part including a first concave part and a second concave part included in top surfaces of an end on the first end face side of the first base part and an end on the second end face side of the second base part, respectively, with the first concave part and the second concave part being connected to each other, and the notch concave part being configured to have a larger width than each width of the first and second rail parts;

a reference positioning part serving as a reference position of each of lower edges on one side, in the width direction, of the first and second rail parts;

a bottom surface support part disposed in the notch concave part, and set between a bottom surface of the notch concave part and bottom surfaces of the first and second rail parts; and a pressing member interposed between a wall part of the notch concave part and lower edges on the other side of the first and second rail parts, and urging the lower edges on the other side of the first and second rail parts toward the reference positioning part, and thereby linearly fixing the first and second linear motor type transport devices to be connected.

2. The connection structure of a linear motor type transport device according to claim 1, further comprising:

a positioning member disposed on one side in the width direction of the notch concave part, and set between a wall part on one side of the notch concave part and the lower edges one one side of the first and second rail parts;

a positioning support member including a support part disposed on the center side in the width direction of the notch concave part, and set between the bottom surface of the notch concave part and the bottom surfaces of the first and second rail parts, and a positioning part set along the lower edges on the other side of the first and second rail parts; and a wedge member disposed on the other side in the width direction of the notch concave part, and thrust into between the wall part on the other side of the notch concave part and the positioning support member, thereby urging the positioning support member toward the positioning member, wherein the reference positioning part has a portion of the positioning member to abut against the first and second rail parts, the support part has the bottom surface support part, and, the pressing member has the positioning member and the wedge member.

3. The connection structure of a linear motor type transport device according to claim 2, wherein the positioning member and the wall part on one side of the notch concave part, the first and second rail parts and the support part, and the wedge member and the bottom part of the notch concave part are fixed by screws, respectively.

4. The connection structure of a linear motor type transport device according to claim 2, wherein a surface of the positioning support member to be in contact with the wedge member is an inclined surface inclined in a direction of heading gradually farther away from the side, on which the wedge member is situated, as this surface heads gradually from the bottom side toward the top side, and a surface of the wedge member to be in contact with the positioning support member is an inclined surface inclined in a direction of gradually heading farther away from the side, on which the positioning support member is situated, as this surface heads gradually from the top side toward the bottom side.

5. The connection structure of a linear motor type transport device according to claim 2, wherein the wedge member is set in any one concave part of the first concave part and the second concave part.

6. The connection structure of a linear motor type transport device according to claim 1, further comprising:

a positioning wall surface part formed in the wall part on one side of the notch concave part such that the lower edges on one side of the first and second rail parts can be therealong;

a positioning support member including a support part disposed in the notch concave part, and set between the bottom surface of the notch concave part and the bottom surfaces of the first and second rail parts, and a positioning part set along the lower edges on the other side of the first and second rail parts; and a wedge member disposed on the other side in the width direction of the notch concave part, and thrust into between the wall part on the other side of the notch concave part and the positioning support member, thereby urging the positioning support member toward the positioning wall surface part, wherein the reference positioning part has the positioning wall surface part, the bottom surface support part has the support part, and the pressing member has the positioning part and the wedge member.

7. The connection structure of a linear motor type transport device according to claim 6, wherein the first and second rail parts and the support part, and the wedge member and the bottom part of the notch concave part are fixed by screws, respectively.

8. The connection structure of a linear motor type transport device according to claim 6, wherein a surface of the positioning support member to be in contact with the wedge member is an inclined surface inclined in a direction of heading gradually farther away from the side, on which the wedge member is situated, this surface heads gradually from the bottom side toward the top side, and a surface of the wedge member to be in contact with the positioning support member is an inclined surface inclined in a direction of heading gradually farther away from the side, on which the positioning support member is situated, as this surface heads gradually from the top side toward the bottom side.

9. The connection structure of a linear motor type transport device according to claim 6, wherein the wedge member is set so as to be situated in any one concave part of the first concave part and the second concave part.

10. The connection structure of a linear motor type transport device according to claim 1, further comprising:

a positioning member disposed on one side in the width direction of the notch concave part, and set between a wall part on one side of the notch concave part and the lower edges on one side of the first and second rail parts;

a positioning support member including a support part disposed in the notch concave part, and set between the bottom surface of the notch concave part and the bottom surfaces of the first and second rail parts, and a positioning part set along the lower edges on the other side of the first and second rail parts;

a tapped hole disposed in the wall part on the other side of the notch concave part, and penetrating through between the outer surface and a surface on the notch concave part side of the other-side wall part; and a screw member for being screwed into the tapped hole from the outer surface of the wall part on the other side, thereby urging the positioning support member toward the positioning member, wherein the reference positioning part has a portion of the positioning member to abut against the rail part, the bottom surface support part has the support part, and the pressing member has the positioning part, the tapped hole, and the screw member.

11. The connection structure of a linear motor type transport device according to claim 10, wherein the positioning member and the bottom part of the notch concave part, and the rail part and the support part are fixed by screws, respectively.

12. The connection structure of a linear motor type transport device according to claim 10, wherein the positioning member is set so as to be situated in both the concave parts of the first concave part and the second concave part, and the pressing member is disposed at the wall part on the other side of the notch concave part correspondingly to both of the first concave part and the second concave part.

* * * * *